US006778042B2

(12) United States Patent
Terashima et al.

(10) Patent No.: US 6,778,042 B2
(45) Date of Patent: Aug. 17, 2004

(54) HIGH-FREQUENCY DEVICE

(75) Inventors: Yoshiaki Terashima, Yokosuka (JP); Fumihiko Aiga, Kamakura (JP); Mutsuki Yamazaki, Yokohama (JP); Hiroyuki Fuke, Kawasaki (JP); Hiroyuki Kayano, Fujisawa (JP); Riichi Katoh, Cambridge (GB)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 09/983,891

(22) Filed: Oct. 26, 2001

(65) Prior Publication Data

US 2002/0050872 A1 May 2, 2002

(30) Foreign Application Priority Data

| | | |
|---|---|---|
| Oct. 30, 2000 | (JP) | 2000-330615 |
| Oct. 31, 2000 | (JP) | 2000-333069 |
| Oct. 31, 2000 | (JP) | 2000-333070 |
| Oct. 31, 2000 | (JP) | 2000-333071 |
| Mar. 29, 2001 | (JP) | 2001-095966 |

(51) Int. Cl.[7] ..... H01P 1/20
(52) U.S. Cl. ..... 333/205; 333/99 S; 505/210
(58) Field of Search ..... 333/99 S, 205; 505/210, 700, 866

(56) References Cited

U.S. PATENT DOCUMENTS

| | | | | |
|---|---|---|---|---|
| 5,391,543 A | | 2/1995 | Higaki et al. | |
| 5,406,233 A | | 4/1995 | Shih et al. | |
| 5,616,538 A | * | 4/1997 | Hey-Shipton et al. | 505/210 |
| 5,965,494 A | | 10/1999 | Terashima et al. | |
| 6,016,434 A | * | 1/2000 | Mizuno et al. | 505/210 |
| 6,347,237 B1 | * | 2/2002 | Eden et al. | 505/210 |
| 6,360,112 B1 | * | 3/2002 | Mizuno et al. | 505/210 |
| 6,463,308 B1 | * | 10/2002 | Wikborg et al. | 505/210 |
| 6,532,377 B1 | * | 3/2003 | Terashima et al. | 505/210 |
| 6,546,266 B1 | * | 4/2003 | Okazaki et al. | 505/210 |

FOREIGN PATENT DOCUMENTS

| | | |
|---|---|---|
| JP | 63-081402 | 5/1988 |
| JP | 2-35461 | 3/1990 |
| JP | 2-159102 | 6/1990 |
| JP | 4-77272 | 7/1992 |
| JP | 4-355804 | 12/1992 |
| JP | 4-368006 | 12/1992 |
| JP | 5-199024 | 8/1993 |
| JP | 9-307307 | 11/1997 |
| JP | 10-51204 | 2/1998 |
| JP | 2000-196308 | 7/2000 |
| JP | 2001-077604 | 3/2001 |
| JP | 2001-211004 | 8/2001 |
| JP | 2001-308605 | 11/2001 |
| JP | 2002-141705 | 5/2002 |
| WO | WO 95/35584 | 12/1995 |

OTHER PUBLICATIONS

A. T. Findikoglu, et al., "Electrically Tunable Coplanar Transmission Line Resonators Using $Yba_2$ $Cu_3$ $O_7$ /$SrTiO_2$ Bilayers", Appl. Phys. Lett., vol. 66 (26), Jun. 26, 1995, pp. 3674–3676.

(List continued on next page.)

*Primary Examiner*—Robert Pascal
*Assistant Examiner*—Kimberly Glenn
(74) *Attorney, Agent, or Firm*—Oblon, Spivak, McClelland, Maier & Neustadt, P.C.

(57) ABSTRACT

A high-frequency device comprises a dielectric substrate, a filter element which has a plurality of resonating elements made of a first superconductor film on the dielectric substrate, a dielectric plate which faces the dielectric substrate substantially in parallel with the substrate and covers the plurality of resonating elements, and a spacing adjusting member configured to control the spacing between the dielectric plate and the dielectric substrate. The high-frequency device enables the pass-band frequency of the filter to be adjusted with high accuracy without variations in the skirt characteristic or ripple characteristic.

19 Claims, 30 Drawing Sheets

OTHER PUBLICATIONS

A. T. Findikoglu, et al., "Tunable and Adaptive Bandpass Filter Using a Nonlinear Dielectric Thin Film of $SrTiO_2$ ", Appl. Phys. Lett., vol. 68 (12), Mar. 18, 1995, pp. 1651–1653.

D. E. Oates, et al., "Tunable Superconducting Resonators Using Ferrite Substrates", IEEE MTT–S Digest, 1997, pp. 303–306.

Jia–Sheng Hong, et al., "On the Development of Superconducting Microstrip Filters for Mobile Communication Applications", IEEE Transactions on Microwave Theory and Techniques, vol. 47, No. 9, Sep. 1999, pp. 1656–1663.

Tomotaka Sakatani, et al., "Mechanical Tuning of Resonant Frequency of a Superconducting Microwave Filter", Proceedings of Spring Meeting of Jpn. Society of Cryogenic Engineering, 2000, p. 146.

Yasuhiro Nagai, et al., "1.5–$GH_2$ Band–Pass Microstrip Filters Fabricated Using EuBaCuO Superconducting Films", Jpn. J. Appl. Phys. vol. 32 Feb. 15, 1993, pp. L 260–L 263.

Dawel Zhang, et al., "Compact Forward–Coupled Superconducting Microstrip Filters for Cellular Communication", IEEE Transactions on Applied Superconductivity, vol. 5, No. 2, Jun. 1995, pp. 2658–2659.

Jia–Sheng Hong, et al., "On the Performance of HTS Microstrip Quasi–Elliptic Function Filters for Mobile Communications Application", IEEE Transactions on Microwave Theory and Techniques, vol. 48, No. 7, Jul. 2000, pp. 1240–1246.

Kentaro Setsune, et al., "Elliptic–Disc Filters of High–$T_c$ Superconducting Films for Power–Handling Capability Over 100 W", IEEE Transactions on Microwave Theory and Techniques, vol. 48, No. 7, Jul. 2000, pp. 1256–1264.

* cited by examiner

| d1 | L | | | | | | |
|---|---|---|---|---|---|---|---|
| | 0. 4mm | 0. 6mm | 1mm | 2mm | 5mm | 10mm | 20mm |
| 0. 2mm | 2dB | 0. 4dB | 0. 2 | 0. 1 | 0. 1 | 0. 05 | 0. 01 |
| 0. 4mm | 3dB | 1dB | 0. 3 | 0. 1 | 0. 1 | 0. 05 | 0. 01 |
| 0. 6mm | 4dB | 2dB | 0. 6 | 0. 3 | 0. 1 | 0. 05 | 0. 01 |

FIG. 8

| d1 | L | | | | | | |
|---|---|---|---|---|---|---|---|
| | 1mm | 2mm | 4mm | 10mm | 15mm | 20mm | 25mm |
| 0. 2mm | 2dB | 0. 4dB | 0. 2 | 0. 1 | 0. 1 | 0. 05 | 0. 01 |
| 0. 4mm | 3dB | 1dB | 0. 3 | 0. 1 | 0. 1 | 0. 05 | 0. 01 |
| 0. 6mm | 4dB | 2dB | 0. 6 | 0. 3 | 0. 1 | 0. 05 | 0. 01 |

FIG. 9

| d1 | L | | | | | | |
|---|---|---|---|---|---|---|---|
| | 0. 4mm | 0. 5mm | 0. 6mm | 1mm | 1. 5mm | 2mm | 2. 5mm |
| 0. 2mm | 2dB | 0. 1dB | 0. 05 | 0. 02 | 0. 01 | 0. 01 | 0. 01 |
| 0. 4mm | 2dB | 0. 1dB | 0. 05 | 0. 02 | 0. 01 | 0. 01 | 0. 01 |
| 0. 6mm | 2dB | 0. 1dB | 0. 05 | 0. 02 | 0. 01 | 0. 01 | 0. 01 |

FIG. 10

HIGH-FREQUENCY DEVICE

CROSS-REFERENCE TO RELATED APPLICATIONS

This application is based upon and claims the benefit of priority from the prior Japanese Patent Applications No. 2000-330615, filed Oct. 30, 2000; No. 2000-333069, filed Oct. 31, 2000; No. 2000-333070, filed Oct. 31, 2000; No. 2000-333071, filed Oct. 31, 2000; and No. 2001-095966, filed Mar. 29, 2001, the entire contents of all of which are incorporated herein by reference.

BACKGROUND OF THE INVENTION

1. Field of the Invention

This invention relates to a high-frequency device, and more particularly to a microwave filter and a high-frequency device related to the microwave filter.

2. Description of the Related Art

A communication apparatus for communicating information by wireless or by wire is composed of various devices, including amplifiers, mixers, and filters. That is, it includes many devices making use of resonance characteristics. For instance, a filter is composed of a plurality of resonating elements arranged side by side and has the function of allowing only a specific frequency band to pass through. Such a filter is required to have a low insertion loss and permit only the desired band to pass through. To meet these requirements, resonating elements with high unloaded Q values are needed.

One method of realizing a resonating element with a high unloaded Q value is to use a superconductor as a conductor constituting a resonating element and further use a material whose dielectric loss factor is very small, such as $Al_2O_3$, MgO, or $LaAlO_3$, as a substrate. In this case, however, the unloaded Q value is 10,000 or more and the resonance characteristic is very sharp. As a result, the desired characteristic cannot be obtained unless the resonance characteristic is adjusted with high accuracy in the design stage.

To overcome such a problem, a resonator and a filter which have the function of adjusting the resonance frequency have been proposed. Methods of tuning the frequency of a resonator or a filter include a method of providing a dielectric whose permittivity depends on the applied electric field in the vicinity of a resonating element and thereby applying a voltage to the dielectric and a method of providing a magnetic material whose permeability varies with the applied magnetic field in the vicinity of a resonating element and applying a magnetic field to the magnetic material.

For example, what has been described in reference 1 ("Electrically tunable coplanar transmission line resonators using $YBa_2Cu_3O_{7-x}/SrTiO_3$ bilayers" by A. T. Findikoglu et al., Appl. Phys. Lett., Vol. 66, p. 3674, 1995) is a method of forming a coplanar resonator composed of an oxide superconductor film on an $LaAlO_3$ substrate whose surface is covered with a dielectric $SrTiO_3$ film whose permittivity depends on the applied electric field and applying a voltage between the central transmission line and the ground on both sides and thereby tuning the resonance frequency f. In this case, the tuning width $\Delta f/f$ is 4%. Since a dielectric whose permittivity depends on the field strength, such as $SrTiO_3$, has a high dielectric loss factor (tan $\delta$), the unloaded Q value decreases to about 200. This causes the following problem: the advantage that use of a very low loss superconductor increases the unloaded Q value disappears.

Similarly, in reference 2 ("Tunable and adaptive bandpass filter using a nonlinear dielectric thin film of $SiTiO_3$" by A. T. Findkoglu et al., Appl. Phys. Lett., Vol. 68, p. 1651, 1996), a tunable band-pass filter composed of a plurality of coplanar resonators capable of performing the aforementioned frequency tuning has been described. In this case, since the unloaded Q value of each resonator constituting the filter is small as described above, the rising and falling of the frequency passband called the skirt characteristics are gentle, impairing the frequency selectivity. There is another problem: when the frequency passband is changed by the application of a voltage, the insertion loss, skirt characteristics, and ripples in the frequency passband vary.

Furthermore, Jpn. Pat. Appln. KOKAI Publication No. 9-307307 or Jpn. Pat. Appln. KOKAI Publication No. 10-51204 has disclosed a filter where a dielectric whose permittivity depends on a voltage is provided on a filter element and a pair of voltage applying electrodes is provided near the dielectric. In this case, it is possible to change the permittivity locally or distribute the permittivity according to the arrangement of electrodes or the applied voltage. This alleviates the above problem to some degree, that is, the problem of changes in the insertion loss, skirt characteristics, and ripples incidental to the tuning of the passing frequency band of the band-pass filter.

This method, however, requires not only a dielectric whose permittivity varies with the applied voltage but also voltage applying electrodes, leading to an additional loss caused by the electrodes. As a result, the unloaded Q value of a single resonator is as small as several hundred or less, which makes it impossible to obtain a filter with a sharp skirt characteristic.

Furthermore, when the tuning of the frequency is done by applying a voltage to the electrode pair and changing the permittivity of the dielectric uniformly, the loss due to the dielectric is great and in addition varies with the applied voltage. Consequently, the Q value of the resonating element constituting the filter varies as a result of tuning, which causes a problem: the insertion loss of the filter and the characteristics in the passband deviate from the desired characteristics. Moreover, this method permits the permittivity and dielectric loss factor to follow a spatial distribution and therefore cannot cause them to vary uniformly all over the surface.

Another method has been described in, for example, reference 3 ("Tunable Superconducting Resonators Using Ferrite Substrates" by D. E. Oates and G. F. Diome, IEEE MTT-S digest, p. 303, 1997). In this method, a plate of magnetic material $Y_3Fe_5O_{12}$ (YIG) whose permeability varies with the applied magnetic field is provided on a microstrip-structure resonator formed on a substrate. A direct-current magnetic field is externally applied to the plate, thereby tuning the resonance frequency. Although the tuning width $\Delta f/f$ is 3%, almost the same as that in the aforementioned dielectric control method, the unloaded Q value has been improved and is about ten times as large as that of a dielectric-control-type resonator. However, when a plurality of resonators with such a tuning function are arranged side by side, thereby forming a band-pass filter capable of tuning the passing frequency band, the electromagnetic coupling between the resonating elements and between the resonating elements and the input and output lines varies because the passing frequency band varies according to the application of the magnetic field. This variation causes a problem: the insertion loss, skirt characteristics, and ripple characteristics of the filter deviate from the original design. Moreover, when the passing frequency band is 5 GHz or less, the insertion loss becomes greater because of the magnetic loss.

Still another method has been disclosed in Jpn. Pat. Appln. KOKAI Publication No. 5-199024. In this method, a superconductive resonator is such that a vertically movable conductor rod, dielectric strip, or magnetic material rod is provided on a resonator with a single resonating conductor and the resonance frequency can be adjusted by controlling the position of the rod. However, to apply the method to a filter where a plurality of resonating elements are arranged side by side, it is necessary to move the conductor rod or the like on each resonating element over the same distance with high accuracy. There is another problem: changing the frequency leads to changes in the characteristics within the band, such as ripples or bandwidth.

In the description of reference 4 ("On the Development of Superconducting Microstrip Filters for Mobile Communications Applications" by Jia-Sheng Hong et al., IEEE Trans. Microwave Theory and Techniques, Vol. 47, No. 9, p.1656, 1999), a filter has been housed in a package and many tuning screws have been provided on the resonating elements and between the resonating elements. The screws are made to go down or up, thereby tuning the frequency. In this case, an increase in the loss as a result of the addition of the tuning function is smaller than in the aforementioned dielectric voltage applying method or magnetic material magnetic field applying method. However, since each screw has a different effect on the filter characteristics, the control of each screw must be performed independently and precisely. The optimum position of each screw must be made different according to the pattern of the filter. For this reason, this method has the problem of having many control parameters, being difficult to adjust, and being complex in structure.

On the other hand, in a communication system, such a skirt characteristic of a band-pass filter as prevents interference between adjacent frequency bands is required. Furthermore, a band-pass filter with a sharp skirt characteristic for making effective use of frequencies is needed.

When the skirt characteristic on the low-frequency side of the passband is made sharper, a filter circuit composed of a hairpin-type resonating element having a pole on the low-frequency side of the passband can be used as described in, for example, "1.5-GHz Band-Pass Microstrip Filters Fabricated Using EuBaCuO Superconducting Films" by Yasuhiro Nagai et al., Japanese Journal of Applied Physics, Vol. 32, p. L260, 1993.

Conversely, when the skirt characteristic on the high-frequency side of the passband is made sharper, a forward-coupled filter having a pole on the high-frequency side of the passband can be used as described in, for example, "Compact Forward-Coupled Superconducting Microstrip Filters for Cellular Communication" by Dawei Zhang et al, IEEE TRANSACTIONS ON APPLIED SUPERCONDUCTIVITY, Vol. 5, No. 2, p. 2656, 1995.

Furthermore, when both sides of the passband are made sharper, a quasi-elliptic-function-type filter having poles on both sides of the passband can be used as described in, for example, "On The Performance of HTS Microstrip Quasi-Elliptic Function Filters for Mobile Communications" by Jia-Sheng Hong et al., IEEE TRANSACTIONS ON MICROWAVE THEORY AND TECHNIQUES, Vol. 48, No. 7, p. 1240, 2000.

In any of the above cases, use of multiple stages of resonating elements enables the skirt characteristics to be made sharper. Since metal filters or dielectric filters cause great losses, they cannot be made multistage. However, use of superconductive filters using superconductors as resonating elements makes it possible to realize multiple stages of filters.

When a communication system requires a very sharp skirt characteristic, even if the filter has poles, a great many resonating elements must be used to realize a multistage structure, which makes the filter circuit larger. For this reason, to produce such a large filter circuit, a very large substrate is needed.

However, it is difficult to produce such a large substrate by using $Al_2O_3$ (sapphire), MgO, $LaAlO_3$, or the like, used for a microstrip-line-type superconductive filter, which results in an increase in its production cost. It is also difficult to form a superconductor film on a large substrate. That is, when a band-pass filter with a very sharp skirt characteristic required in a communication system is realized using conventional techniques, the following problems are encountered: one problem is that it is difficult to prepare a large substrate on which a superconductor film has been formed; and another problem is that, even if such a substrate has been prepared, the production cost is very high.

Furthermore, a superconductive band-pass filter with a high-power-resistant transmission characteristic, such as a transmission filter in a wireless base station, is realized by constructing the filter using large resonating elements as described in, for example "Elliptic-Disc Filters of High-Tc Superconducting Films for Power-Handling Capability Over 100W" by Kentaro Setsune et al., IEEE TRANSACTIONS ON MICROWAVE THEORY AND TECHNIQUES, Vol. 48, No. 7, p.1256, 2000. However, to realize a sharp skirt characteristic required in the system, it is necessary to use a large number of resonating elements for a multistage structure. This causes the following problems: it is difficult to prepare such a large substrate that enables a lot of large resonating elements to be formed; and if such a substrate has been prepared, its production cost is very high.

There arises another problem: when a superconductive filter circuit becomes large, this makes larger the mounting system that houses the filter circuit, resulting in an increase in the cooling cost for realizing the superconducting characteristics.

On the other hand, a band-pass filter whose characteristics, including the center frequency and bandwidth, are variable is indispensable to the construction of a communication infrastructure capable of flexibly copying with modifications to the system. With a conventional characteristic-variable band-pass filter, each amount of the coupling between resonating elements constituting the filter and the external Q were controlled independently, thereby obtaining the desired filter characteristic and its change as described in Jpn. Pat. Appln. KOKAI Publication No. 9-307307. Therefore, to change the characteristic of a multistage filter with a sharp skirt characteristic by the method of the conventional characteristic-variable band-pass filter, it is necessary to control a great many couplings between resonating elements, resulting in an enormous number of parameters to be controlled, which makes it difficult to change the characteristic of the multistage filter.

As described above, it was not easy to obtain a band-pass filter with a sharp skirt characteristic because a large substrate was needed in the prior art. It was also difficult to adjust the transmission characteristic of the filter accurately. For this reason, there have been demands toward realizing a filter device which has a sharp skirt characteristic and is capable of obtaining a desired transmission characteristic easily.

BRIEF SUMMARY OF THE INVENTION

A high-frequency device according to a first aspect of the present invention comprises: a dielectric substrate with a first and a second main surface; a filter element which has a plurality of resonating elements made of a first superconductor film on the first main surface of the dielectric substrate; a dielectric plate having a third and a fourth main surface, the third main surface of the dielectric plate facing the first main surface of the dielectric substrate, the dielectric plate being substantially in parallel with the first main surface, and the dielectric plate covering the plurality of resonating elements; and a spacing adjusting member configured to control a spacing between the third main surface of the dielectric plate and the first main surface of the dielectric substrate.

A high-frequency device according to a second aspect of the present invention comprises: a substrate; a filter series where a plurality of band-pass filters are connected in series, each of the plurality of band-pass filters being composed of a plurality of resonating elements made of a superconductor film formed on the substrate; and a resonance controller configured to control resonance frequencies of the plurality of resonating elements forming at least one band-pass filter.

BRIEF DESCRIPTION OF THE SEVERAL VIEWS OF THE DRAWING

FIG. 8 is a table to help explain the relationship between the dimensions and the magnitude of ripples when spacing adjusting members are provided at ends of dielectric plate in the second embodiment;

FIG. 9 is a table to help explain the relationship between the dimensions and the magnitude of ripples when a spacing adjusting member made of metal is provided in the middle of a dielectric plate in the first embodiment;

FIG. 10 is a table to help explain the relationship between the dimensions and the magnitude of ripples when a spacing adjusting member made of a dielectric is provided in the middle of a dielectric plate in the first embodiment;

DETAILED DESCRIPTION OF THE INVENTION

Hereinafter, referring to the accompanying drawings, embodiments of the present invention will be explained.

(First Embodiment)

Figure 1:
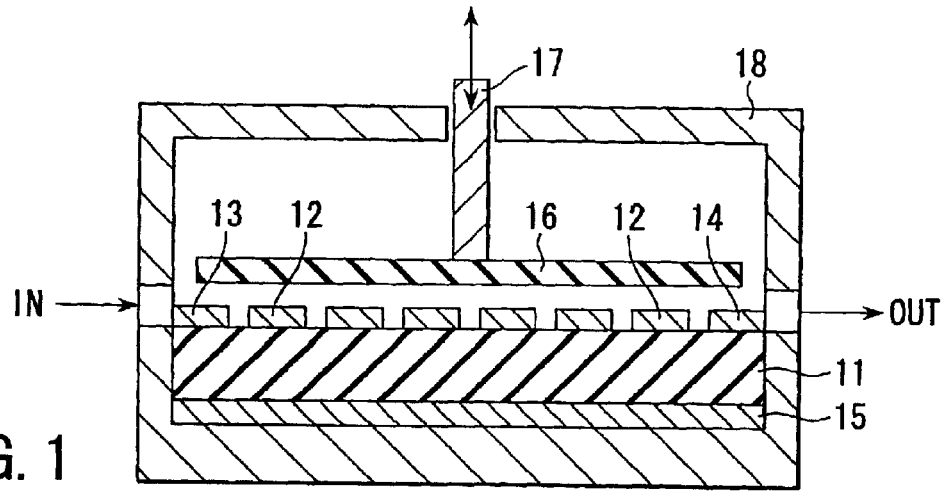
FIG. 1 is a sectional view showing the basic configuration of a high-frequency device according to a first embodiment of the present invention.

FIG. 1 shows a microwave high-frequency device according to a first embodiment of the present invention. More specifically, FIG. 1 is a sectional view of a band-pass filter capable of adjusting the passing frequency band.

The band-pass filter of the first embodiment has a microstrip line structure where a plurality of resonating elements 12, an input line 13, and an output line 14 are formed on the surface of a dielectric substrate 11 and a ground plane 15 is formed on the back of the dielectric substrate 11. The dielectric substrate 11 is made of a dielectric material whose dielectric loss factor is small. For example, $Al_2O_3$ (sapphire), MgO, or $LaAlO_3$ may be used as the dielectric material.

The resonating elements 12, input line 13, output line 14, and ground plane 15 are made of superconductive materials. $Re_1Ba_2Cu_3O_X$ (Re is such a rare earth element as Y, Ho, or Yb), oxide superconductors of the Bi family, or oxide superconductors of the T1 family may be used as superconductive materials.

Above the dielectric substrate 11, a dielectric plate 16 made of a dielectric material (such as $Al_2O_3$ (sapphire) MgO, or $LaAlO_3$) whose dielectric loss factor is small is provided almost in parallel with the surface of the dielectric substrate 11 in such a manner that it faces the substrate. The dielectric plate 16 is also provided so as to cover the plurality of resonating elements 12, the gaps between the individual resonating elements 12, the gap between a resonating element 12 and the input line 13, and the gap between a resonating element 12 and the output line 14.

Figure 2A:
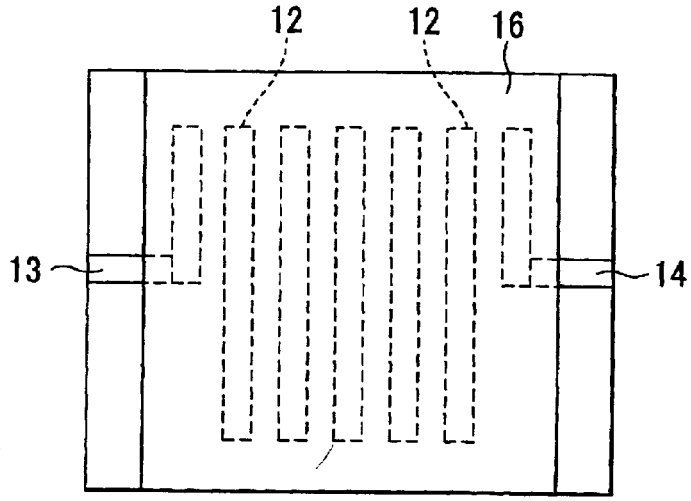
FIGS. 2A and 2B are plan views showing the positional relationship in plane between resonating elements and a dielectric plate in the first embodiment and show an example of a dielectric plate covering all over the surface of a substrate at which resonating elements have been formed and an example of a dielectric plate covering half of the surface of the substrate, respectively.
Figure 2B:
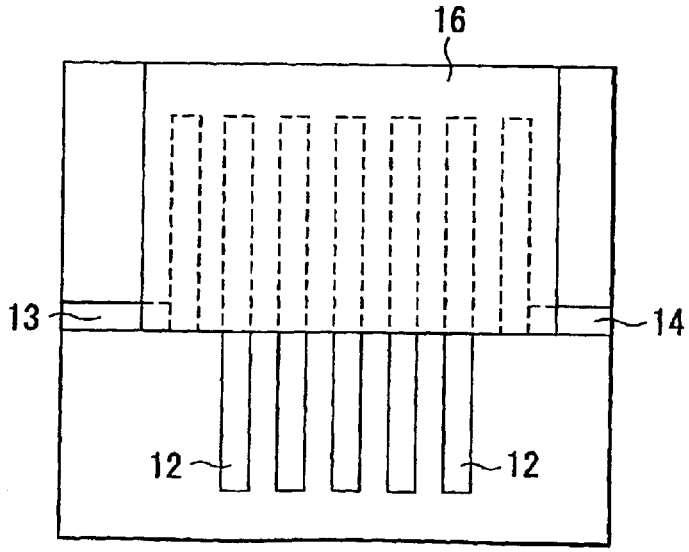

FIGS. 2A and 2B are plan views showing the positional relationship between the dielectric plate 16 and resonating elements and others. FIG. 2A shows an example of providing the dielectric plate 16 in such a manner that the plate 16 covers the individual resonating elements 12 and all the gaps between the individual resonating elements 12. FIG. 2B shows an example of providing the dielectric plate 16 in such a manner that the plate 16 covers more than half of the individual resonating elements 12 and the gaps between the individual resonating elements 12.

The dielectric plate 16 is provided with a spacing adjusting member 17 for adjusting the spacing between the surface of the dielectric substrate 11 and the facing surface of the dielectric plate 16. Moving the spacing adjusting member 17 vertically in a through hole made in a package 18 enables the dielectric plate 16 to move in the direction perpendicular to the surface of the dielectric substrate 11, while keeping the dielectric plate 16 in parallel with the dielectric substrate 11.

At the band-pass filter, a passband is produced as a result of the superposition of resonances of the individual resonating elements. The factors that determine the passing frequency are the length of the resonating elements and the effective permittivity and effective permeability of the medium surrounding the resonating elements. The factors that determine the skirt characteristics and ripples are the unloaded Q values of the resonating elements, the coupling between the resonating elements, and the coupling between the resonating elements and the input and output lines. The coupling between the resonating elements and the coupling between the resonating elements and the input and output lines are determined by the length of the gap between them and the effective permittivity and effective permeability of the medium surrounding them.

In a tunable band-pass filter with the configuration as shown in FIG. 1, when the spacing between the dielectric plate 16 and dielectric substrate 11 is changed by moving the dielectric plate 16 vertically, the effective permittivity changes on the whole and therefore the resonance frequencies of all the resonating elements 12 shift uniformly, with the result that the transmission characteristic of the filter shifts on the frequency axis. At this time, the coupling between the resonating elements 12 and the electromagnetic coupling between the resonating elements 12 and input line 13 and between the resonating elements 12 and output line 14 also change at the same time. For this reason, it has been considered that the skirt characteristic of the filter and its ripples would differ from the initial characteristics and ripples.

However, the inventors of this application have found out the following fact for the first time: the dielectric plate 16 is provided so as to cover all the resonating elements 12, the gaps between the individual resonating elements 12, the gap between a resonating element 12 and input line 13, and the gap between a resonating element 12 and output line 14 as shown in FIGS. 2A and 2B, and then the dielectric plate 16 is moved, while being kept in parallel with the dielectric substrate 11, that is, the dielectric plate 16 is moved in such a manner that the positional relationship between each of the areas and the dielectric plate 16 changes equally, with the result that changes in the aforementioned skirt characteristics and ripples can be prevented.

Use of a dielectric material whose dielectric loss factor is small for the dielectric plate 16 enables a tunable band-pass filter to be obtained almost without alleviating the unloaded Q values of the resonating elements or the insertion loss and skirt characteristics of the filter.

Hereinafter, as an example of a band-pass filter having the basic configuration as shown in FIG. 1, an example of producing a filter with a 1.9-GHz-band microstrip line structure will be explained.

A 0.5-mm-thick, 30-mm-diameter $LaAlO_3$ substrate was used as the dielectric substrate 11. On both sides of the dielectric substrate 11, a superconductor thin film of the Y family was formed to a thickness of 500 nm by sputtering techniques. The superconductor thin film formed on the back side of the substrate was made a ground plane 15. The superconductor thin film formed on the front side of the substrate was processed by ion milling techniques to form five resonating elements 12 with a desired resonance frequency, input line 13, and output line 14, thereby forming a band-pass filter with a microstrip line structure. Each resonating element 12 had the same shape with a width of about 170 $\mu$m and a length of about 20.2 mm and has a passband center frequency of about 1.9 GHz.

A copper cover 18 is mounted on the filter formed as described above. A copper screw acting as the spacing adjusting member 17 is set in a through hole made in the center of the cover. At the tip of the screw, the dielectric plate 16 made of a 0.5-mm-thick, 28-mm-diameter $Al_2O_3$ (sapphire) is provided. By turning the screw, the dielectric plate 16 can be brought close to or separated away from the filter element.

The filter characteristics were evaluated as follows. The element produced as described above was put in a refrigerator and cooled down to 60 K. In this state, the microwave power transmission characteristic and reflection characteristic of the filter were measured with a vector network analyzer.

Figure 3:
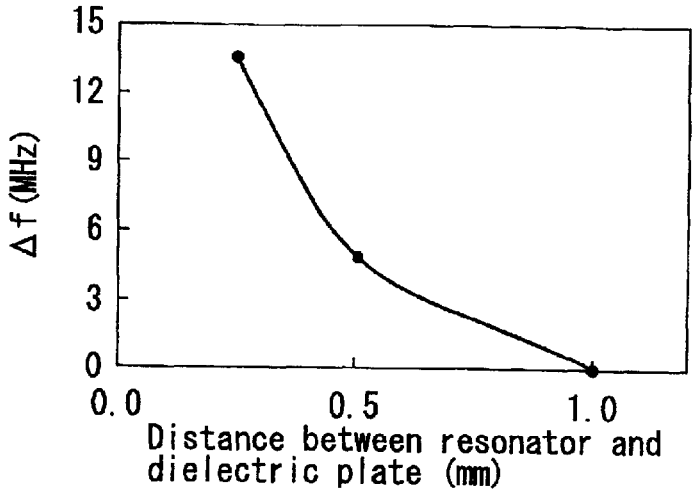
FIG. 3 shows the relationship between the resonating-element-to-dielectric-plate distance and a variation in the passband center frequency in the first embodiment.
Figure 4:
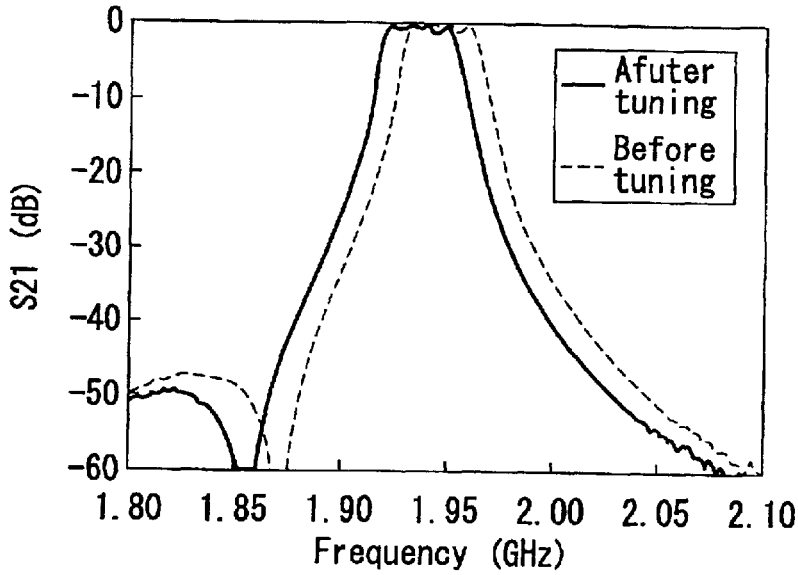
FIG. 4 shows the comparison between the frequency transmission characteristic (S21) before tuning and that after tuning in the first embodiment.

FIG. 3 shows the relationship between the distance between the filter elements on the dielectric substrate 11 and the dielectric plate 16 and a variation $\Delta f$ in the passband center frequency. FIG. 4 shows the result of measuring S parameter S21 (transmission characteristic) when the distance between the filter elements and the dielectric plate is varied. In FIG. 4, the characteristic before tuning was obtained when the distance between them was 1 mm or more and the characteristic after tuning was obtained when the distance between them was 0.25 mm. Although making the distance shorter caused the passband to shift toward the low frequency side, there was no change in the in-band characteristics, including the insertion loss, bandwidth, and ripples.

While in the above embodiment, $Al_2O_3$ (sapphire) was used for the dielectric plate 16, use of MgO produced the same effect. When $LaAlO_3$ was used for the dielectric plate 16, the amount of shift of the passband was about 1.5 times as large as that when $Al_2O_3$ or MgO was used.

As described above, in the first embodiment, it is possible to adjust only the center frequency of the passband without sacrificing a decrease in the loss caused by the superconductivity of the resonating elements or changing the ripples, skirt characteristics, and bandwidth.

For comparison's sake, a filter whose basic configuration was the same as that of the above concrete example but differed in the way the dielectric plate 16 was provided was measured in the same manner. Specifically, the dielectric plate was provided in such a manner it was inclined so that the value of the expression $2\times(L-S)/(L+S)$ may be larger than 0.3, where the maximum value and minimum value of the spacing between the surface of the dielectric plate 16 facing the dielectric substrate 11 and the surface of the superconductor film constituting the resonating elements 12 are L and S respectively. In this case, there arose a problem: ripples in the in-band transmission characteristics increased or the symmetry collapsed.

Figure 5:
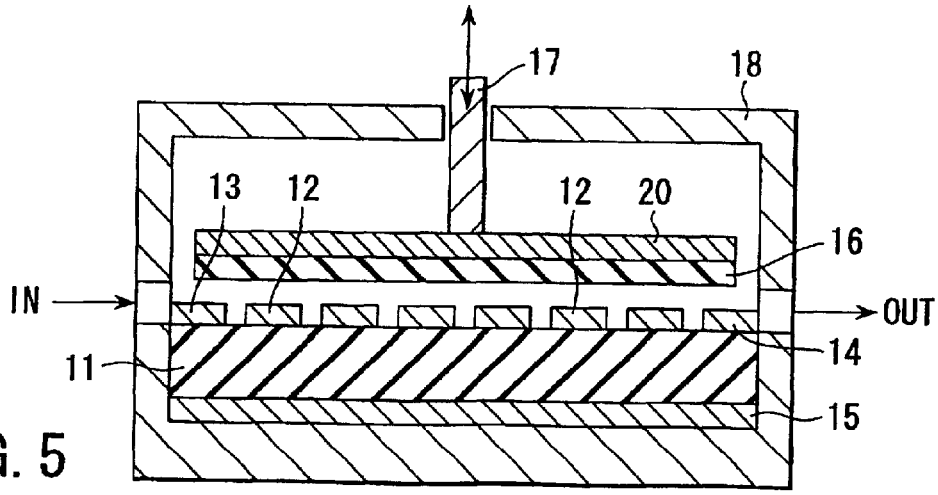
FIG. 5 is a sectional view of a modification of the first embodiment.

As a modification of the first embodiment, an element as shown in FIG. 5 was formed. Its basic configuration is the same as that of FIG. 1. The component parts corresponding to the component parts shown in FIG. 1 are indicated by the same reference numerals. The modification of FIG. 5 differs from the example of FIG. 1 in that a superconductor film 20 is formed on the surface of the dielectric plate 16 opposite to its surface facing the filter elements 12. With such a configuration, when the microwave transmission characteristic was measured in the same manner as described above, a greater frequency variable width than that of the configuration of FIG. 1 was obtained.

With the first embodiment, the dielectric plate is provided so as to be almost in parallel with the surface of the substrate at which a filter has been formed and to cover the resonating elements and the gaps between the individual resonating elements. Adjusting the spacing between the dielectric plate and the substrate at which the filter has been formed enables the transmission characteristic of the filter to be adjusted easily and accurately without variations in the skirt characteristics, ripple characteristic, and the like.

(Second Embodiment)

Figure 6:
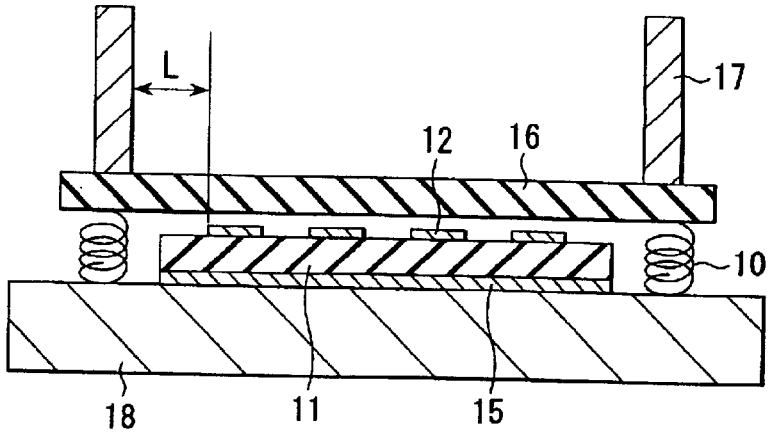
FIG. 6 is a sectional view of a high-frequency device according to a second embodiment of the present invention.

FIG. 6 is a sectional view of a microwave high-frequency device according to a second embodiment of the present invention. Because the basic configuration of the second embodiment is similar to that of the first embodiment, the same parts as those of the first embodiment are indicated by the same reference numerals. The same holds true for a third and later embodiments.

In the second embodiment, too, a band-pass filter has a microstrip line structure where a plurality of resonating elements 12 are formed on the surface of a dielectric substrate 11 and a ground plane 15 is formed on the back of the dielectric substrate 11. The dielectric substrate 11, resonating elements 12, and ground plane 15 are made of the same material as that in the first embodiment.

The resonating elements 12 and ground plane 15 are obtained by forming a superconductor film on the surface and back of the dielectric substrate 11 by such techniques as CVD, vacuum deposition, sputtering, or pulse laser ablation and then processing the superconductor film formed on the surface of the dielectric substrate 11 by ion milling techniques to get a desired resonance frequency.

Above the dielectric substrate 11, the same dielectric plate 16 as that in the first embodiment is provided so as to be substantially in parallel with the surface of the dielectric substrate 11.

Like FIGS. 2A and 2B, FIGS. 7A and 7B show the positional relationship between the dielectric plate 16 and the resonating elements 12 and others. In the example of FIG. 2A, the dielectric plate 16 faces almost all the surface of the dielectric substrate 11 excluding the connection area between the power input/output terminal 13 or 14 and the resonating elements 12. That is, the dielectric plate 16 is provided so as to cover all the area including the plurality of resonating elements 12 and the gaps between the individual resonating elements 12. The positional relationship between the dielectric plate 16 and the resonating elements 12 may be such that the dielectric plate 16 is provided so as to cover more than half of the individual resonating elements 12 and the gaps between the individual resonating elements.

Figure 7A:
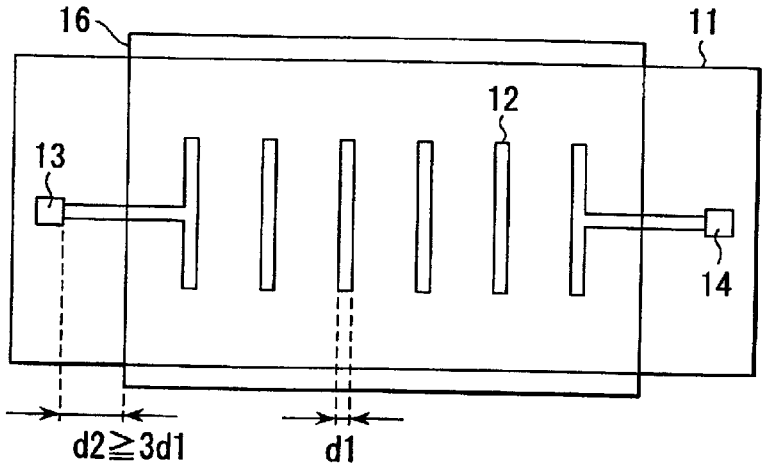
FIGS. 7A and 7B show the positional relationship in plane in the second embodiment and the definition of dimensions or distances serving as main factors.
Figure 7B:
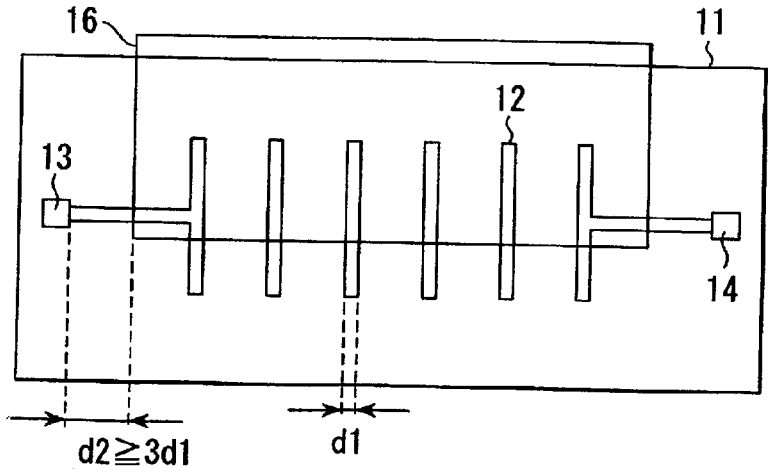

In both of FIGS. 7A and 7B, the distance d2 from the input/output terminal 13 or 14 to the dielectric plate 16 is at least three times or more, preferably 10 times or more, as large as the line width d1 of a resonating element 12. When the distance is shorter than these values, this has an adverse effect on the transmission characteristic of high-frequency power.

In the third or later embodiments, too, it is desirable that the basic positional relationship between the dielectric plate 16, resonating elements 12, input/output terminals 13, 14, and others should be as shown in FIGS. 7A and 7B.

In the second embodiment, a post-like spacing adjusting member 17 for adjusting the spacing between the surface of the dielectric substrate 11 and the facing surface of the dielectric plate 16 is provided at each of the ends of the dielectric plate 16. Between a holder 18 on which the dielectric substrate 11 is placed and the dielectric plate 16, a spacer 10 made of an elastic member, such as a spring, is provided.

The up-and-down movement of the dielectric plate 16 by the spacing adjusting members 17 enables the dielectric plate 16 to move in the direction perpendicular to the surface of the dielectric substrate 11, while keeping the dielectric plate 16 in parallel with the dielectric substrate 11.

The minimum distance (approximated by the horizontal distance L in FIG. 6) between the spacing adjusting member 17 or spacer 10 and a resonating element 12 is at least three times or more, preferably ten times or more, as large as the line width d1 of a resonating element 12. When the distance is too small, there is a possibility that an unnecessary resonance will appear in the transmission characteristic of the filter.

FIG. 8 shows the transmission characteristic (the ripples) when the distance L between the spacing adjusting member 17 and resonating element 12 and the line width d1 of a resonating element 12 were varied. From this table, it is seen that, in a case where the spacing adjusting member 17 is made of a material whose dielectric loss factor is large, such as metal, a filter with a transmission characteristic suitable for practical use is obtained when the expression $3d1 \leqq L$, preferably $10d1 \leqq L$, is fulfilled.

Furthermore, when the spacing adjusting member 17 is made of a material whose dielectric loss factor is large, such as metal, and is just above the filter forming area as in the first embodiment, the distance has to be made still larger. FIG. 9 shows the ripple appearing when the distance (l shown in FIG. 11) between the dielectric plate 16 and the resonating elements 12 is made constant (at l=0.2 mm) and the distance (L shown in FIG. 11) between the spacing adjusting member 17 and the resonating elements 12 is varied by changing the thickness of the dielectric plate 16. It is desirable that the distance should be 20 times or more, preferably 50 times or more, as large as the line width d1 of the resonating element 12.

However, even if the spacing adjusting member 17 is above the filter forming area, when the spacing adjusting member 17 is made of a material whose dielectric loss factor is small, such as sapphire, the distance has only to be 0.5 mm or more, preferably 1 mm or more, regardless of the width d1 of the resonating element 12 as shown in FIG. 10.

Figure 11:
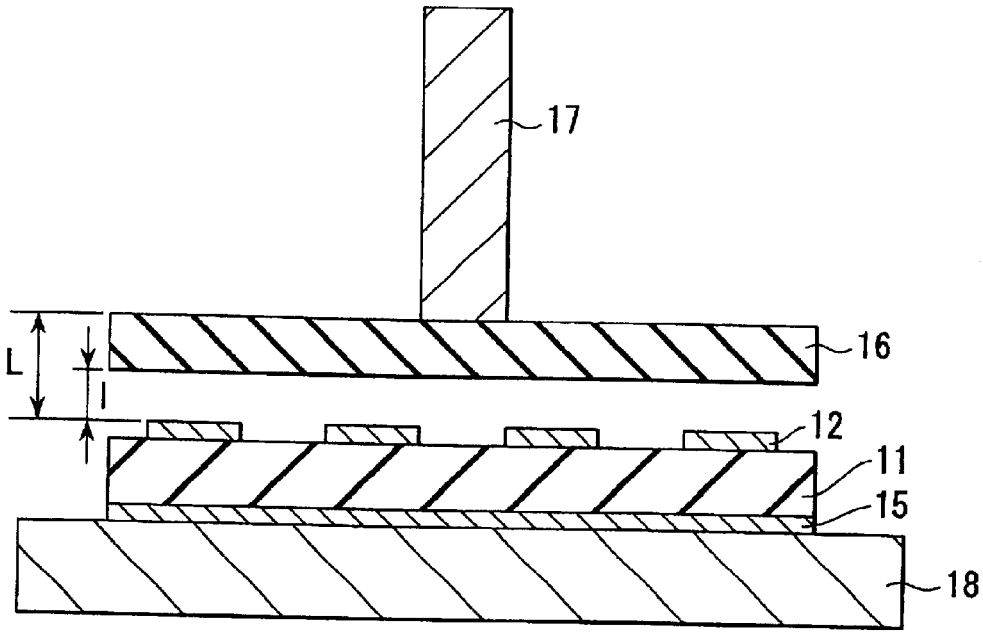
FIG. 11 shows a definition of L in FIGS. 9 and 10.

The minimum distance between the spacing adjusting member 17 and resonating element 12, with the spacing adjusting member 17 above the filter forming area, was approximated by the distance L between the top surface of the dielectric plate 16 and the top surface of the resonating element 12 as shown in FIG. 11. In this approximation, the data in FIGS. 9 and 10 was obtained.

As described above, with the second embodiment, the distance between the spacing adjusting member 17 and the resonating elements 12 is made larger than a specific value, which makes it possible to obtain a filter whose skirt characteristic is sharp and whose center frequency is variable, while keeping the skirt characteristic and the filter characteristics, such as the bandwidth, unchanged.

Hereinafter, concrete examples of the second embodiments will be explained.

CONCRETE EXAMPLE 1

As shown in FIGS. 6, 7A and 7B, 500-nm-thick superconductor films were formed by pulse laser ablation techniques on both sides of a 1-mm-thick, 50-mm-diameter $LaAlO_3$ monocrystalline substrate 11 and then the superconductor film on one side was processed by lithographic techniques to form the patterns of resonating elements 12. This substrate 11 was put on the grounded holder 18 and secured there with a jig (not shown). In addition, above the holder 18, a 1-mm-thick sapphire plate 16 was placed via a plurality of springs 10 with a spacing of 1.5 mm between the holder 18 and the plate 16. The filter formed as described above was used as a microwave communication filter for about 2 GHz, while it was being cooled down to 77 K. From the use of the filter, it was verified that the filter had a sharper attenuation characteristic than that of a filter using Cu and that changing the distance between the superconductor film and the sapphire plate by the spacing adjusting member 17 caused the center resonance frequency of 2 GHz to be changed by 20 MHz.

CONCRETE EXAMPLE 2

In the members formed as in concrete example 1, the member 17 for changing the distance between the superconductor film and the sapphire plate was made of sapphire and was placed above the filter forming area. When such a filter was used as a microwave communication filter for about 2 GHz, it was verified that the filter had a sharper attenuation characteristic than that of a filter using Cu and was able to not only change the center resonance frequency of 2 GHz by 20 MHz but also make corrections, such as eliminating ripples in the band.

(Third Embodiment)

Figure 12:
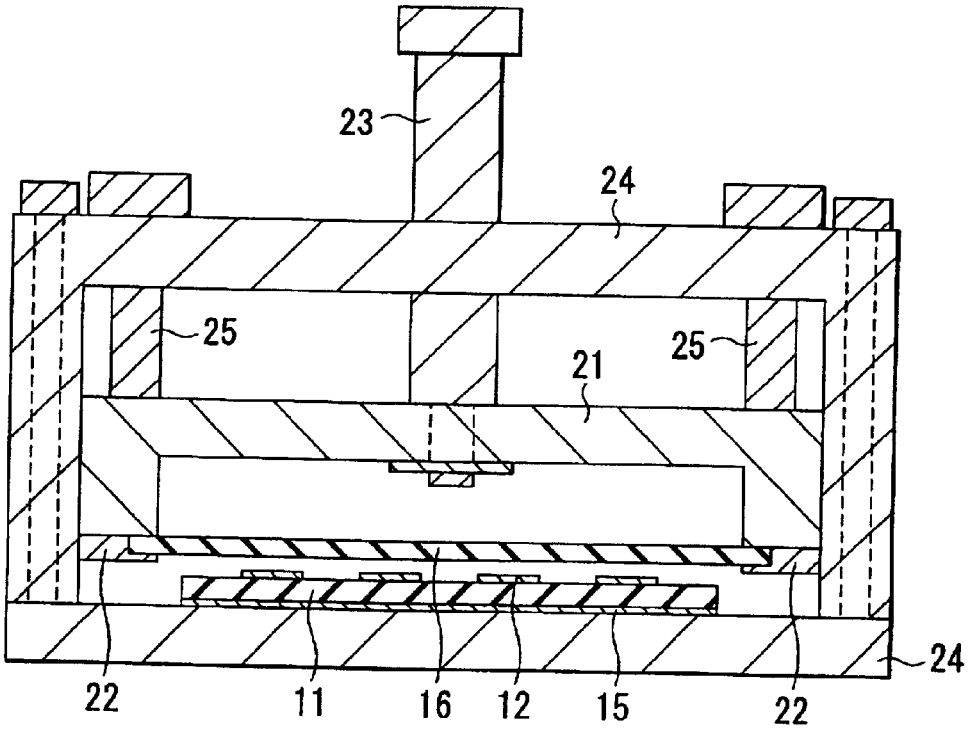
FIG. 12 is a sectional view of a high-frequency device according to a third embodiment of the present invention.

FIG. 12 is a sectional view of a microwave high-frequency device according to a third embodiment of the present invention.

In the third embodiment, the dielectric plate 16 is attached to a metal holding jig 21 whose cross section is shaped like a squared U by means of fixing members 22. The holding jig 21 is provided on a lift jig 23 supported by a metal case 24. By moving up and down the holding jig 21 with the lift jig 23, the distance between the dielectric substrate 11 and the dielectric plate 16 can be changed. At least three or more adjusting screws 25 enable the surface of the dielectric substrate 11 and the facing surface of the dielectric plate 16 to be adjusted so as to be in parallel with each other.

In the third embodiment, a filter with excellent characteristics can be obtained as in the second embodiment.

(Fourth Embodiment)

Figure 13:
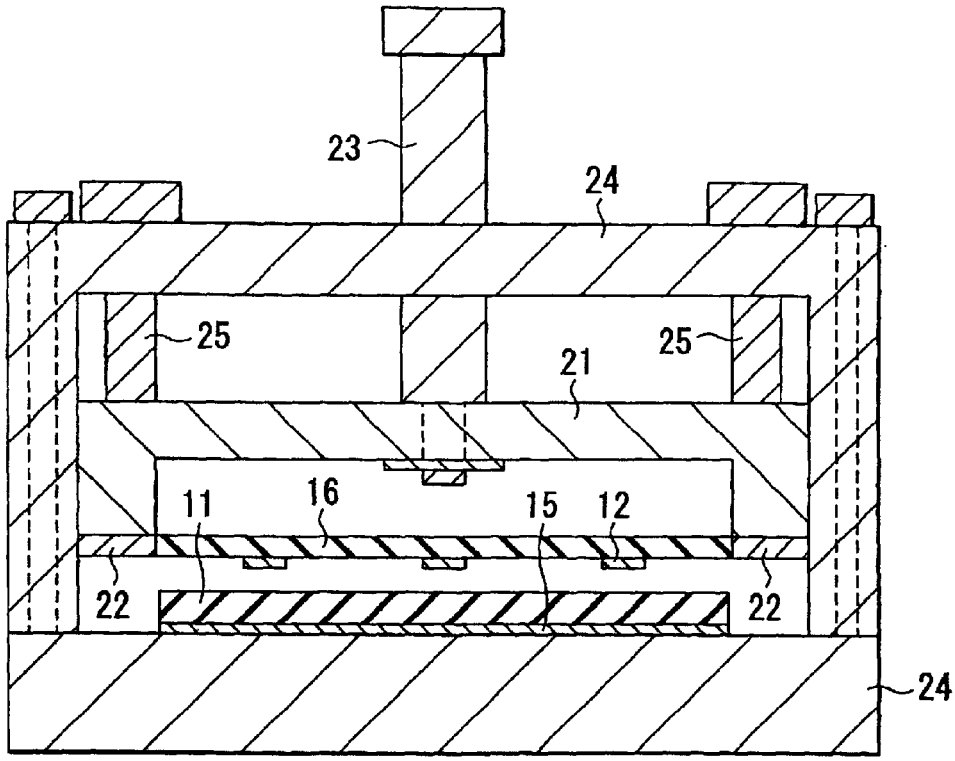
FIG. 13 is a sectional view of a high-frequency device according to a fourth embodiment of the present invention.

FIG. 13 is a sectional view of a microwave high-frequency device according to a fourth embodiment of the present invention.

While in the first to third embodiments, the superconductor film constituting the resonating elements 12 and the superconductor film constituting the ground plane 15 have been formed on the top surface and bottom surface of the same dielectric substrate, the resonating elements 12 are formed at the main surface of the dielectric plate 16 that faces the dielectric substrate 11 in the fourth embodiment.

In FIG. 13, the dielectric plate 16 is attached to the holding jig 21 as in the example of FIG. 12 in such a manner that the plate 16 faces the dielectric substrate 11. By moving up and down the dielectric plate 16 attached to the holding jig 21, the dielectric plate 16 on which the resonating elements 12 have been formed can be moved in the direction perpendicular to the dielectric substrate 11 on which the ground plane has been formed.

As described above, providing the resonating elements 12 on the movable dielectric plate 16 enables the variation of the thickness of the dielectric plate from one substrate to another to be absorbed. Furthermore, it is possible to prevent variations in the characteristics as a result of an abnormality in the interface that might occur if the resonating elements 12 were provided on the dielectric substrate 11.

Figure 14:
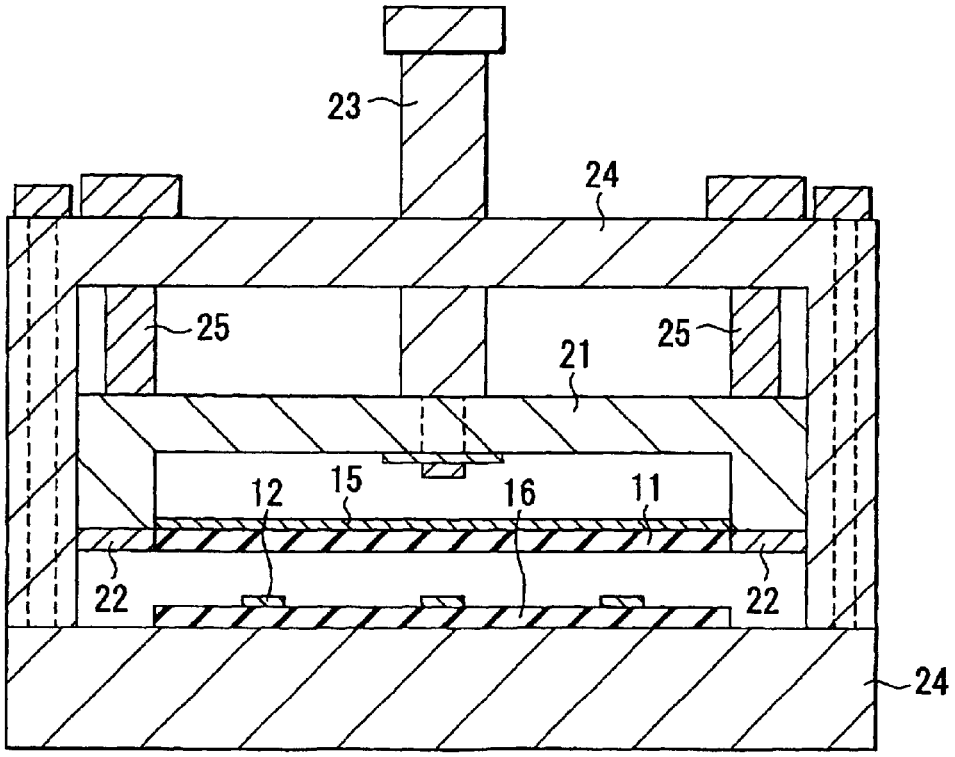
FIG. 14 is a sectional view of a modification of the fourth embodiment.

FIG. 14 is a sectional view of a modification of the fourth embodiment. In contrast with the example of FIG. 13, the dielectric substrate 11 on which the ground plane 15 has been formed is attached to the holding jig 21 in such a manner that the substrate 11 faces the dielectric plate 16 on which the resonating elements 12 have been formed. The dielectric substrate 11 attached to the holding jig 21 is caused to move up and down. In this way, either the dielectric substrate 11 on which the ground plane 15 has been formed or the dielectric plate 16 on which the resonating elements 12 have been formed may be moved.

Here, it is assumed that the positional relationship between the dielectric substrate 11 sandwiched between the ground plane 15 and resonating elements 12 or between the dielectric plate 16 and the resonating elements 12 is the same as that in FIG. 2A or FIG. 2B.

Figure 15:
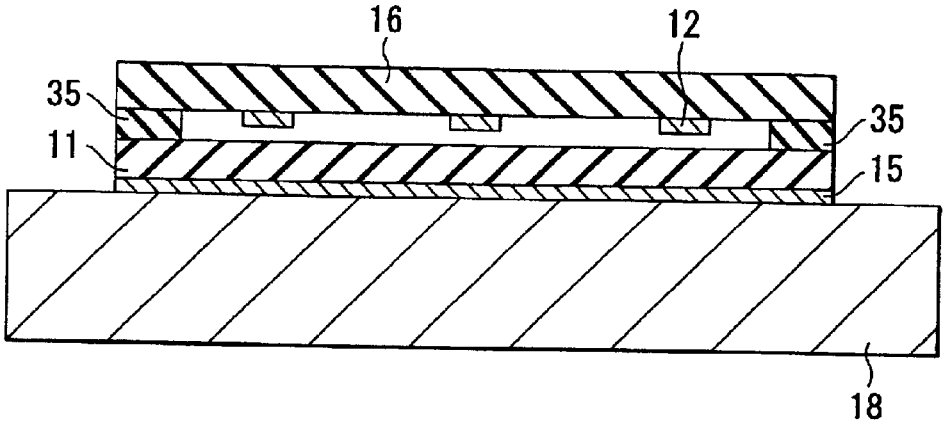
FIG. 15 is a sectional view of another modification of the fourth embodiment.

FIG. 15 is a sectional view of still another modification of the fourth embodiment. While, in the examples of FIGS. 13 and 14, either the dielectric substrate 11 or dielectric plate 16 has been movable vertically, the spacing between the dielectric substrate 11 and the dielectric plate 16 is adjusted for frequency adjustment and thereafter the dielectric substrate 11 and dielectric plate 16 are fixed via a spacer 35 in this modification.

(Fifth Embodiment)

Figure 16:
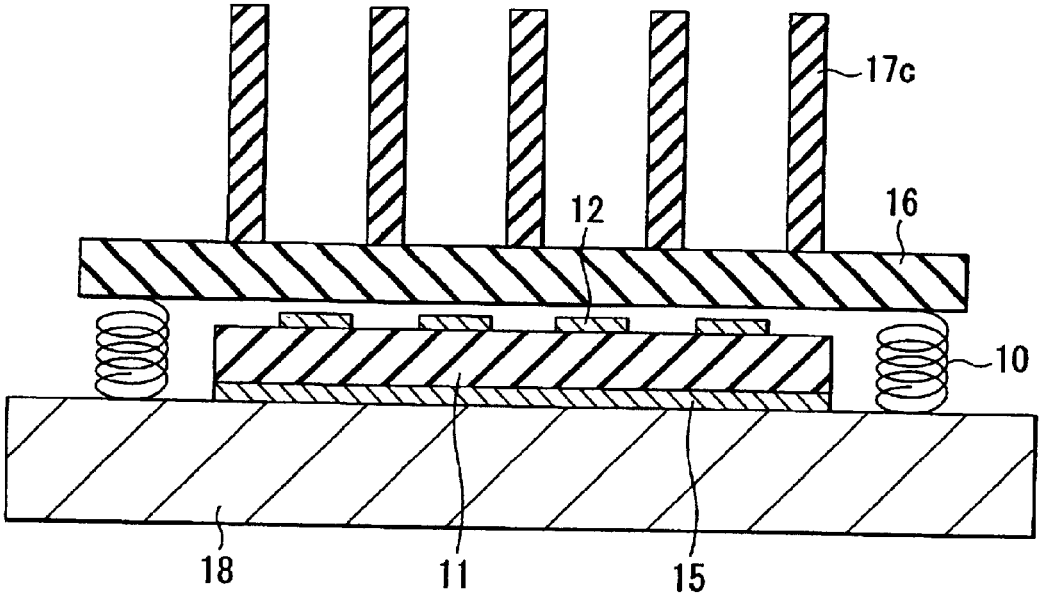
FIG. 16 is a sectional view of a high-frequency device according to a fifth embodiment of the present invention.

FIG. 16 is a sectional view of a microwave high-frequency device according to a fifth embodiment of the present invention.

The basic configuration of the fifth embodiment is the same as that of FIG. 6 except that post-like members 17*c* made of a dielectric material whose dielectric loss factor (tan δ) is small are provided on the dielectric plate 16 as a spacing adjusting member for adjusting the spacing between the dielectric substrate 11 and the dielectric plate 16. Although MgO, $Al_2O_3$ (sapphire), $LaAlO_3$, or the like may be used as the dielectric material, sapphire is best because it has a great mechanical strength.

Use of the post-like members 17*c* made of a dielectric material whose dielectric loss factor (tan δ) is small prevents a disturbance, such as an unnecessary resonance, from appearing in the transmission characteristic, even if the dielectric plate 16 has touched the resonating elements 12. Furthermore, the correction of the transmission characteristic, such as the reduction of ripples, can be made by providing a plurality of post-like members 17*c* and adjusting the members independently.

Figure 17A:
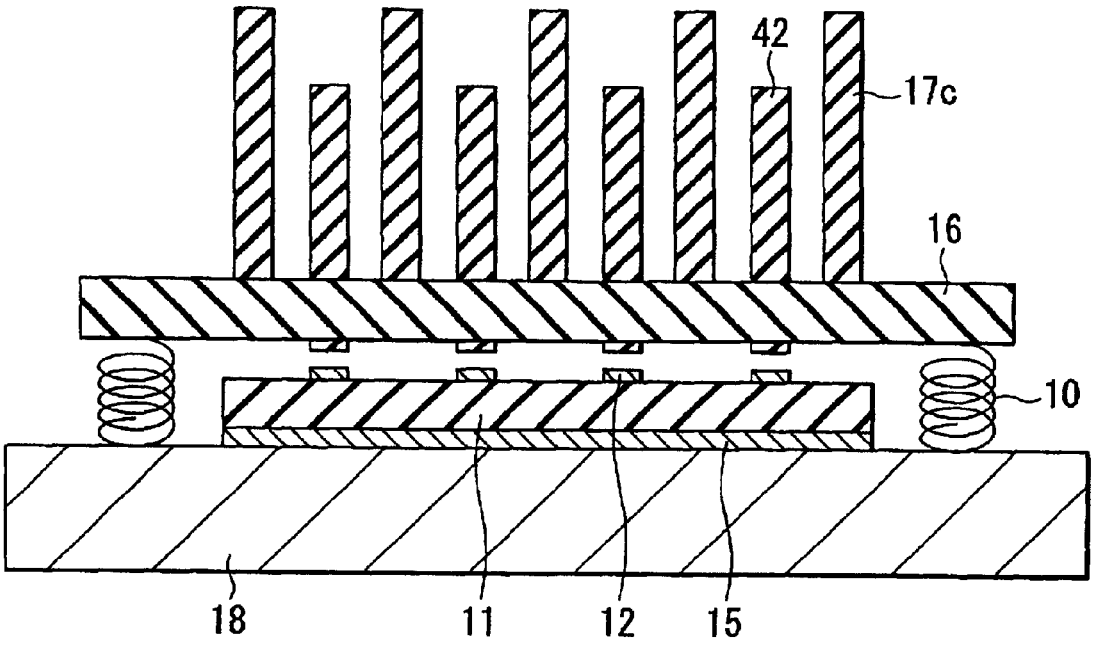
FIGS. 17A and 17B are a sectional view and a top view of a modification of the fourth embodiment.
Figure 17B:
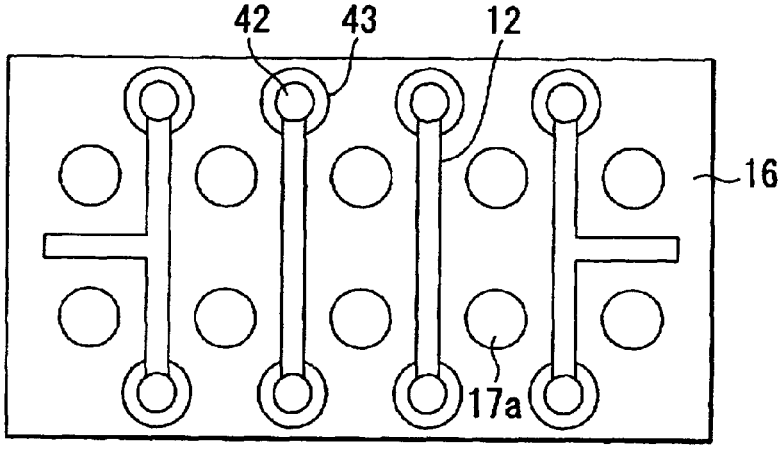

FIGS. 17A and 17B show a modification of the fifth embodiment. FIG. 17A is a sectional view of the modification and FIG. 17B is its top view.

The basic configuration of the modification is the same as that of FIG. 16 except that through holes 43 are made in the dielectric plate 16 and penetration members 42 are provided in such a manner that the members 42 can move up and down in the through holes 43. Like the post-like members 17*c*, the penetration members 42 are made of a dielectric material whose dielectric loss factor is small. The positions in which the penetration members 42 are provided are set near the ends of the superconductor pattern constituting the resonating elements 12 as shown in FIG. 17B.

The plurality of resonating elements 12 constituting the filter must have the same resonance frequency. Part of the resonating elements 12 might have different resonance frequencies, because the permittivity or thickness of the plate varies at the surface of the dielectric substrate 11. In this case, a problem, such as ripples, arises in the passband. In this modification, to overcome this problem, the penetration members 42 corresponding to the ends of the resonating elements 12 whose resonance frequency has shifted are adjusted, thereby changing the effective length of the resonating element, which makes a fine adjustment of the resonance frequency. This makes it possible to correct the transmission characteristic of the filter. To change the center resonance frequency of the filter, the post-like members 17*c* are caused to press the dielectric plate 16 at the places where the through holes 43 have not been made, thereby adjusting the spacing between the dielectric substrate 11 and dielectric plate 16 in the same manner as in FIG. 16.

Hereinafter, a concrete example of the fifth embodiment will be explained.

On a filter on which a plurality of straight-line resonating elements 12 were arranged in parallel, a sapphire plate 16 (see FIG. 17A) in which through holes 43 were made so as to correspond to the ends of the resonating elements was provided. In addition, there were provided post-like members 17*c* made of sapphire which enabled the distance between the superconductor film and sapphire plate to be varied and penetration members 42 made of sapphire. When the filter formed as described above was used as a microwave communication filter for about 2 GHz, the attenuation characteristic of the filter was sharper than that of a filter using Cu and the center resonance frequency of 2 GHz was changed by 20 MHz. Furthermore, ripples in the passband were corrected more accurately by bringing the penetration members 42 close to the ends of a given resonating element via through holes made in the sapphire plate.

(Sixth Embodiment)

Figure 18A:
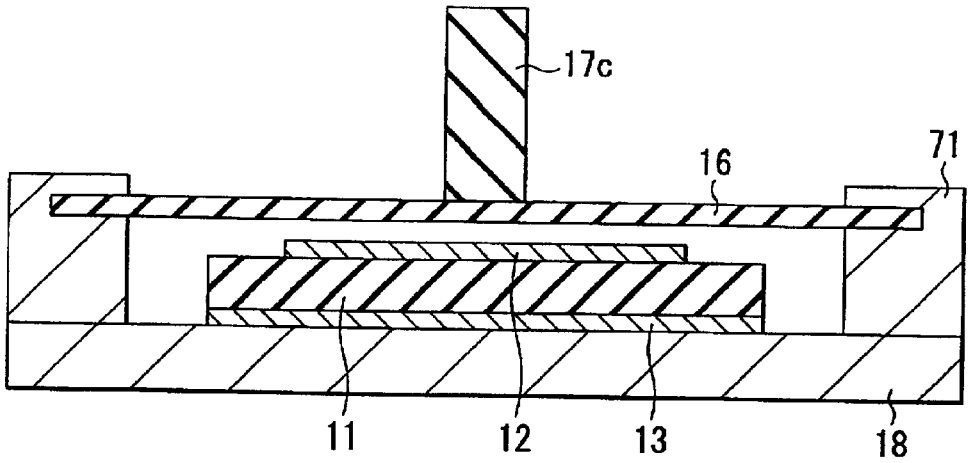
FIGS. 18A and 18B are sectional views of a high-frequency device according to a sixth embodiment of the present invention.
Figure 18B:
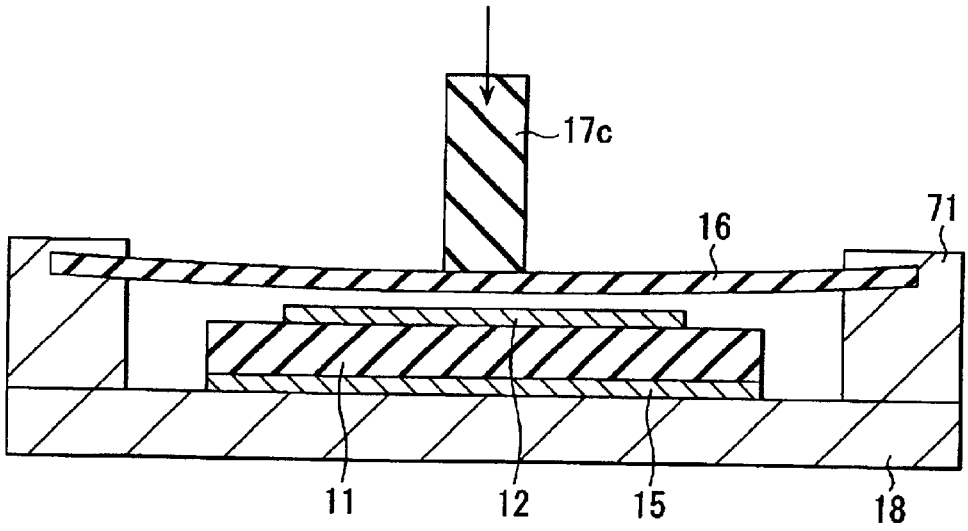
Figure 19:
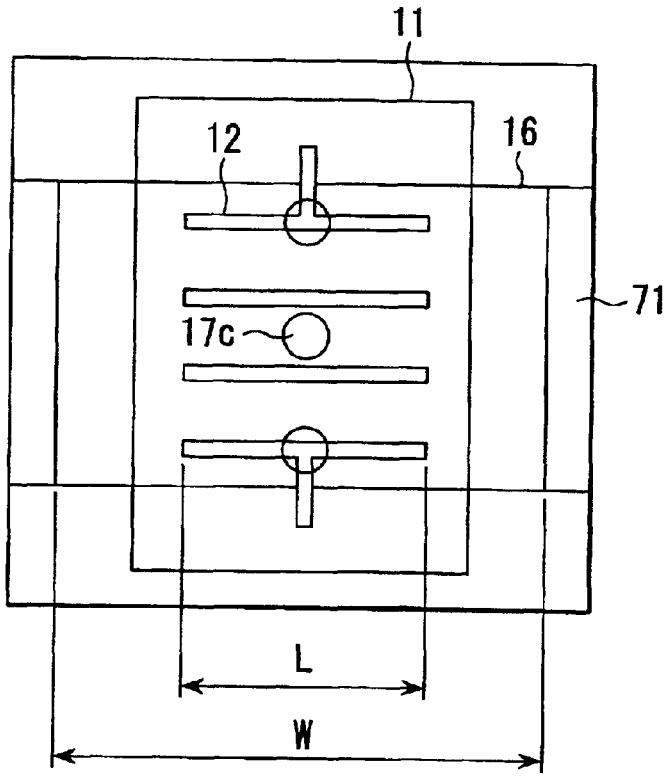
FIG. 19 is a schematic plan view of the sixth embodiment.

FIGS. 18A and 18B are sectional views of a microwave high-frequency device according to a sixth embodiment of the present invention. FIG. 19 is a plan view of the high-frequency device.

Figure 20:
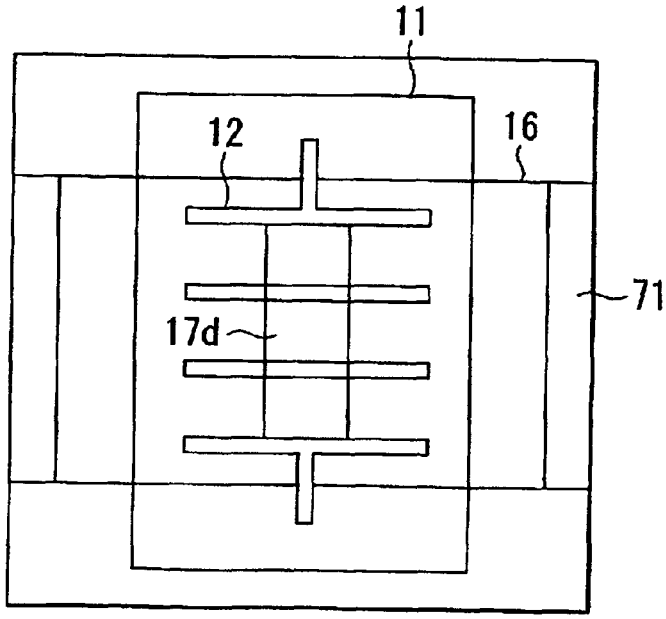
FIG. 20 is a schematic plan view of a modification of the sixth embodiment.

The sixth embodiment is such that both ends of the dielectric plate 16 are supported by an end supporting jig 71 and a post-like member 17*c* made of a dielectric material whose dielectric loss factor is small is provided near the center of the dielectric plate 16 as shown in FIG. 18A and that the post-like member 17*c* is pressed to bend the dielectric plate 16 as shown in FIG. 18B. Instead of the post-like member 17*c*, a plate-like member 17*d* may be provided as shown in FIG. 20. Because the support jig 71 is fixed in the sixth embodiment, the distance and parallelism between the dielectric plate 16 and the superconductor film constituting the resonating elements 12 can be controlled with high accuracy. Moreover, the number of parts to be adjusted in varying the center frequency of the filter is smaller.

The width W of the dielectric plate 16 is greater than the length Ls of the superconductor patterns constituting the resonating elements. Specifically, the width W is set to 1.1×Ls or more, preferably 1.5×Ls. If the width W is below such a range, the parallelism between the dielectric substrate 11 and dielectric plate 16 exceeds the permitted range. This might cause a problem: when the frequency is changed, ripples will take place in the passband.

(Seventh Embodiment)

Figure 21:
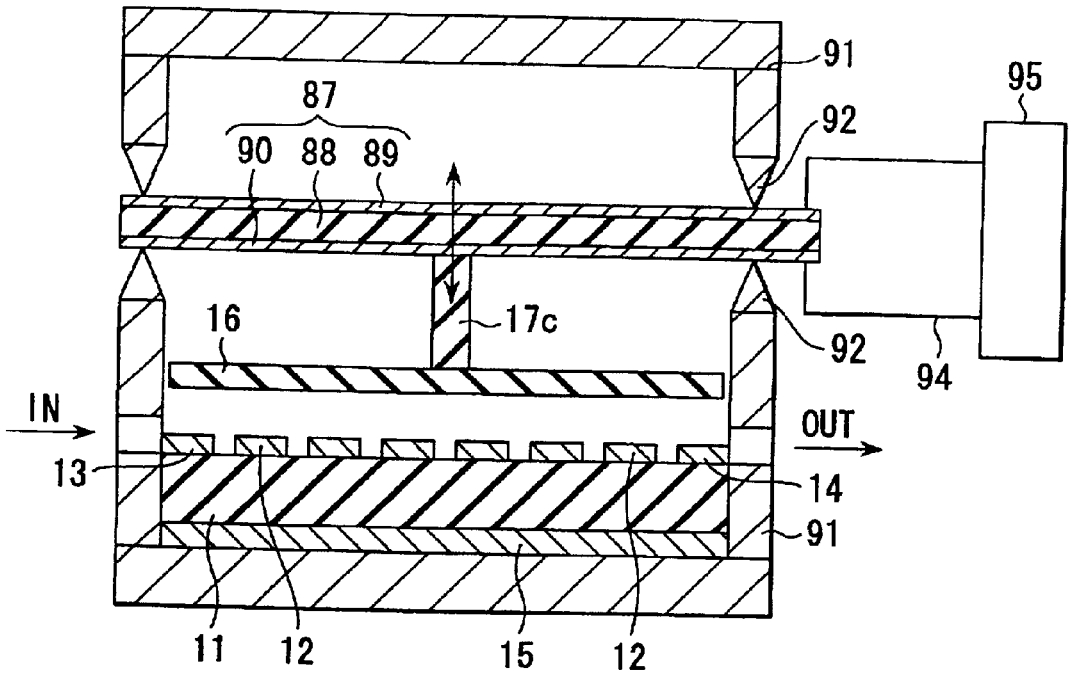
FIG. 21 is a sectional view of a high-frequency device according to a seventh embodiment of the present invention.

FIG. 21 is a sectional view of a high-frequency device according to a seventh embodiment of the present invention. The main parts of the high-frequency device of the seventh embodiment are the same as those in the first embodiment (see FIG. 1) expect that the spacing adjusting member 17*c* provided on the dielectric plate 16 is driven by a piezoelectric element 87.

Specifically, the piezoelectric element 87 is provided above the dielectric plate 16. The piezoelectric element 87 is such that a piezoelectric material 88 is sandwiched between an upper electrode 89 and a lower electrode 90. The ends of the piezoelectric element 87 are secured by fixing sections 92 provided to a package 91. For example, the overall plane shape (the plane shape of the side in parallel with the dielectric plate 16) of the piezoelectric element 87 may be rectangular. In this case, the places near the short sides of the rectangle facing each other are secured by the fixing sections 92.

The dielectric plate 16 and piezoelectric element 87 are connected via the connection member 17*c*. A rod-like member made of a dielectric material whose dielectric loss factor is small may be used as the connection member 17*c*. The rod-like member is secured to the top-surface central part of the dielectric plate 16 and the bottom-surface central part of the piezoelectric element 87.

A direct-current power supply 95 whose output voltage is variable is connected via wires 94 to the upper electrode 89 and lower electrode 90 of the piezoelectric element 87. The piezoelectric element 87 varies according to the voltage of the direct-current power supply 95 applied between the upper electrode 89 and lower electrode 90. Since the ends of the piezoelectric element 87 are fixed, the variation becomes the largest at the central part of the piezoelectric element 87, that is, at the place where the connection member 17*c* is connected. Because the dielectric plate 16 is connected via the connection member 17*c* to the central part of the piezoelectric element 87, the dielectric plate 16 moves up and down according to variations in the central part of the piezoelectric element 87. That is, with the dielectric plate 16 in parallel with the dielectric substrate 11, the dielectric plate 16 moves in the direction perpendicular to the surface of the dielectric substrate 11, thereby adjusting the spacing between the dielectric plate 16 and the dielectric substrate 11.

Hereinafter, a concrete example of the present invention will be explained.

Figure 22:
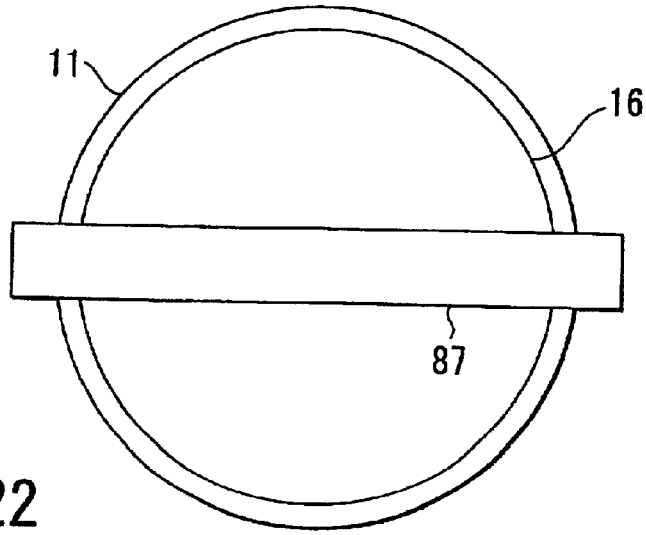
FIG. 22 is a schematic plan view showing the positional relationship between the main parts of a high-frequency device according to the seventh embodiment.

As an example of a band-pass filter having the basic configuration as shown in FIG. 21, a filter with a 1.9-GHz-band microstrip line structure was formed. FIG. 22 is a plan view showing the positional relationship between the dielectric substrate 11, dielectric plate 16, and piezoelectric element 87 in the seventh embodiment.

An $LaALO_3$ substrate with a thickness of about 0.5 mm and a diameter of about 30 mm was used as the dielectric substrate 11. On both sides of the dielectric substrate 11, superconductor thin films of the Y family are formed to a thickness of about 500 nm by sputtering techniques. The superconductor thin film formed on the back of the substrate was made a ground plane 15. The superconductor thin film formed on the front side of the substrate was processed by ion milling techniques to form five resonating elements 12 with a desired resonance frequency, an input line 13, and an output line 14, thereby forming a band-pass filter with a microstrip line structure. Each resonating element 12 had the same shape with a width of about 170 $\mu$m and a length of about 20.2 mm and had a passband center frequency of about 1.9 GHz.

The filter formed as described above was housed in the body of a copper package 91. Between its top and the cover of the package 91, a bender-type piezoelectric element 87 (piezoelectric actuator) with a length of about 70 mm and a width of about 10 mm was provided with its ends fixed. Use of a piezoelectric actuator whose plane shape is rectangular enables the stroke (the displacement) to be made larger. The upper electrode 89 and lower electrode 90 are insulated from the package 91 with a Teflon sheet (not shown). The direction in which the piezoelectric element 87 was installed (or the direction of the long side) was set in the direction perpendicular to the direction in which the resonating elements 12 were arranged (or the direction going from the input line 13 to the output line 14).

Furthermore, an $Al_2O_3$ (sapphire) dielectric plate 16 with a thickness of about 0.5 mm and a diameter of about 28 mm was provided in the central part of the piezoelectric actuator 87 via a sapphire rod (connection member 17*c*) with a diameter of about 5 mm and a length of 10 mm. The spacing between the dielectric plate 16 and filter element 12 was set to about 0.35 mm, with no voltage applied to the piezoelectric actuator.

Figure 23:
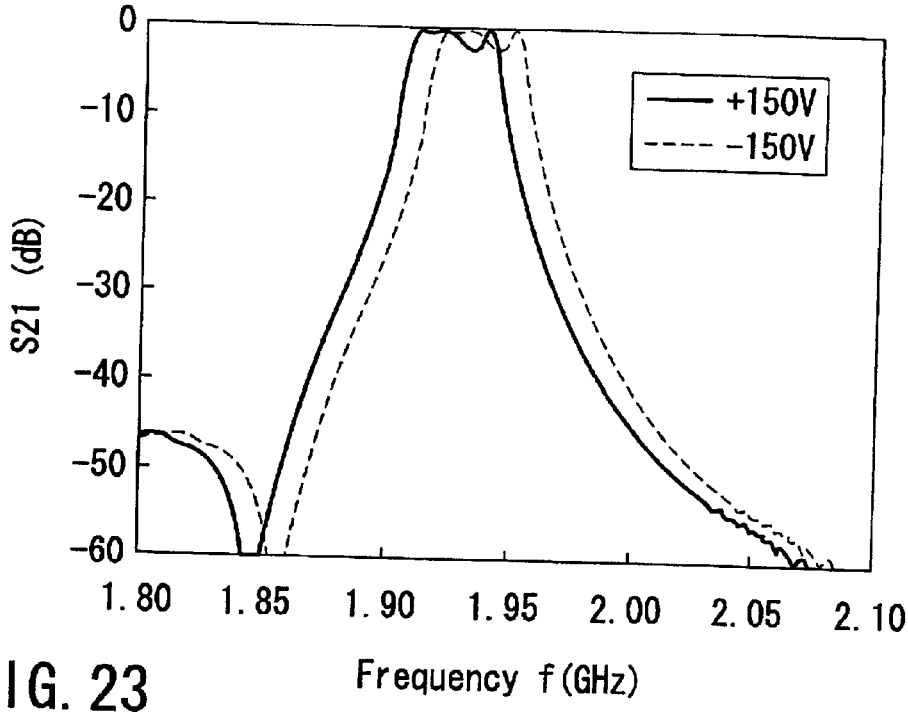
FIG. 23 shows a transmission characteristic of a filter when the applied voltage to a piezoelectric element is changed in the seventh embodiment.

FIG. 23 shows the result of measuring S parameter S21 (or the transmission characteristic) of the filter when voltages of +150 V and −150 V were applied to the piezoelectric actuator. Changing the applied voltage caused the dielectric plate to move up and down, which shifted the passband center frequency by about 12 MHz. However, there was no change in the in-band characteristics, including the insertion loss, bandwidth, and ripples.

While in the example, $Al_2O_3$ (sapphire) was used for the dielectric plate 16, use of MgO produced the same effect. When $LaAlO_3$ was used for the dielectric plate 16, the amount of shift in the passband was about 1.5 times as great as that in the case of $Al_2O_3$ or MgO.

As described above, with the seventh embodiment, only the center frequency of the passband can be adjusted without sacrificing a decrease in the loss caused by the superconductivity of the resonating elements or changing the ripples, skirt characteristics, and bandwidth.

Hereinafter, a modification of the seventh embodiment will be explained.

Figure 24:
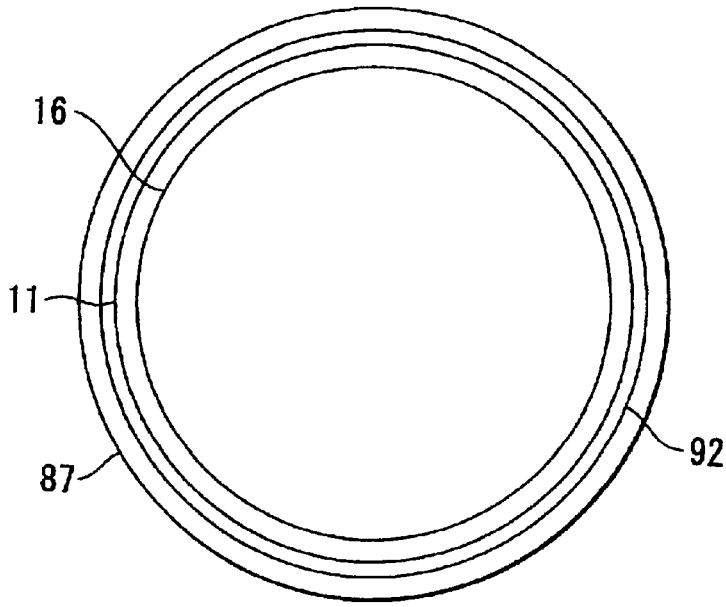
FIG. 24 is a schematic plan view showing the positional relationship between the main parts of a high-frequency device related to a modification of the seventh embodiment.

FIG. 24, which shows a first modification of the seventh embodiment, is a plan view showing the positional relationship between the dielectric substrate 11, dielectric plate 16, piezoelectric element 87, and fixing portion 92 for the piezoelectric element 87. The basic configuration of the device is the same as that of FIG. 21. The overall basic cross-sectional shape is the same as that of FIG. 21 except that the plane shape of the piezoelectric element 87 is circular, whereas the overall plane shape of the piezoelectric element 87 in FIG. 21 is rectangular.

The same filter as that in the preceding concrete example was formed. In the filter, the piezoelectric element 87 was so formed that it had a disk-like shape with a diameter of about 50 mm. The periphery of the piezoelectric element 87 was secured to the package 91 with the fixing portion 92 extending along the entire periphery.

Since the disk-type piezoelectric actuator had a smaller stroke than that of the bender type, the amount of shift in the center frequency of the filter was about half the amount of shift in a bender-type piezoelectric actuator with a length of about 70 mm. However, the parallelism between the filter forming surface of the dielectric substrate 11 and the facing surface of the dielectric plate was better than that in the bender type.

Figure 25:
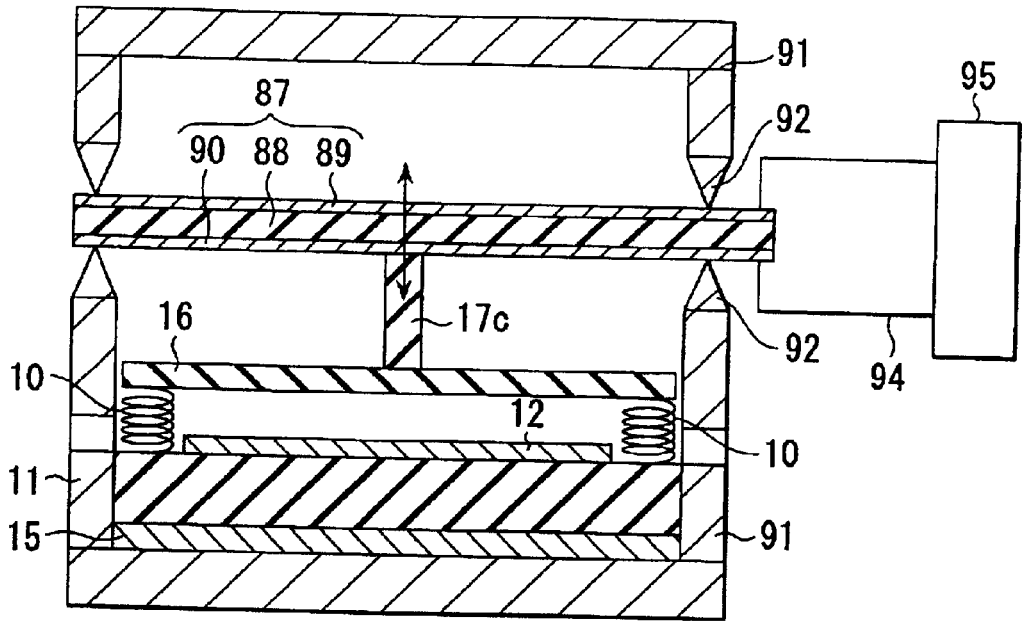
FIG. 25 is a sectional view of a high-frequency device related to another modification of the seventh embodiment.

FIG. 25, which shows a second modification of the seventh embodiment, is a sectional view in the direction perpendicular to the direction in which the resonating elements are arranged (or the direction of input and output). The basic configuration is the same as that of FIG. 12 except that springs 10 are inserted as elastic members between the dielectric substrate 11 and dielectric plate 16 in this modification.

As described above, the springs 10 are provided between the dielectric substrate 11 and dielectric plate 16 and the returning stress of the springs is applied vertically to the dielectric plate 16, which prevents the spacing between the dielectric substrate 11 and dielectric plate 16 from varying due to vibrations (for example, vibrations caused by a refrigerator or the like for cooling the filter) and further the characteristics of the filter from being unstable.

Figure 26:
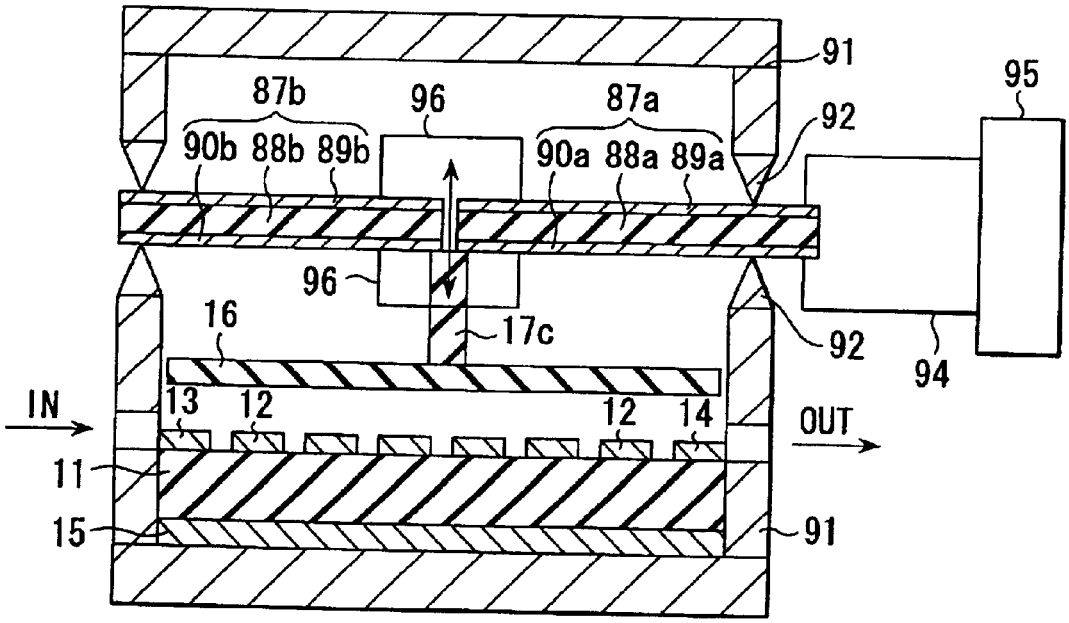
FIG. 26 is a sectional view of a high-frequency device related to still another modification of the seventh embodiment.

FIG. 26 shows a third modification of the seventh embodiment. While, in the modifications explained above, a single piezoelectric element has been used as a piezoelectric portion, a plurality of piezoelectric areas constitute a piezoelectric portion in the third modification.

In the example of FIG. 26, a piezoelectric portion is composed of two piezoelectric elements 87*a*, 87*b*. One end of each piezoelectric element is secured to a fixing portion 92 in a similar manner to the way shown in FIG. 21 and the other end is connected to a connection member 17*c*. The other end may be connected directly or via the member joining both of the piezoelectric elements 87*a* and 87*b* to the connection member 17*c*. The upper electrodes 89*a* and 89*b* and lower electrodes 90*a* and 90*b* of the piezoelectric elements 87*a* and 87*b* are set to the same potential using wires (Au wires) 96. This modification also produced the same effect as that of the above concrete examples.

Instead of connecting the piezoelectric elements 87*a* and 87*b* with the wires 96, the piezoelectric elements 87*a* and 87*b* may be controlled independently, thereby displacing them independently. Independent control of the piezoelectric elements 87*a* and 87*b* enables the tilt angle of the dielectric plate 16 to the dielectric substrate 11 to be adjusted, which makes it possible to adjust the parallelism between the filter forming surface of the substrate 11 and the facing surface of the dielectric plate 16 accurately.

Next, a high-frequency apparatus using the aforementioned high-frequency devices (see FIGS. 21 to 26) using the aforementioned piezoelectric elements will be explained.

(Eighth Embodiment)

Figure 27:
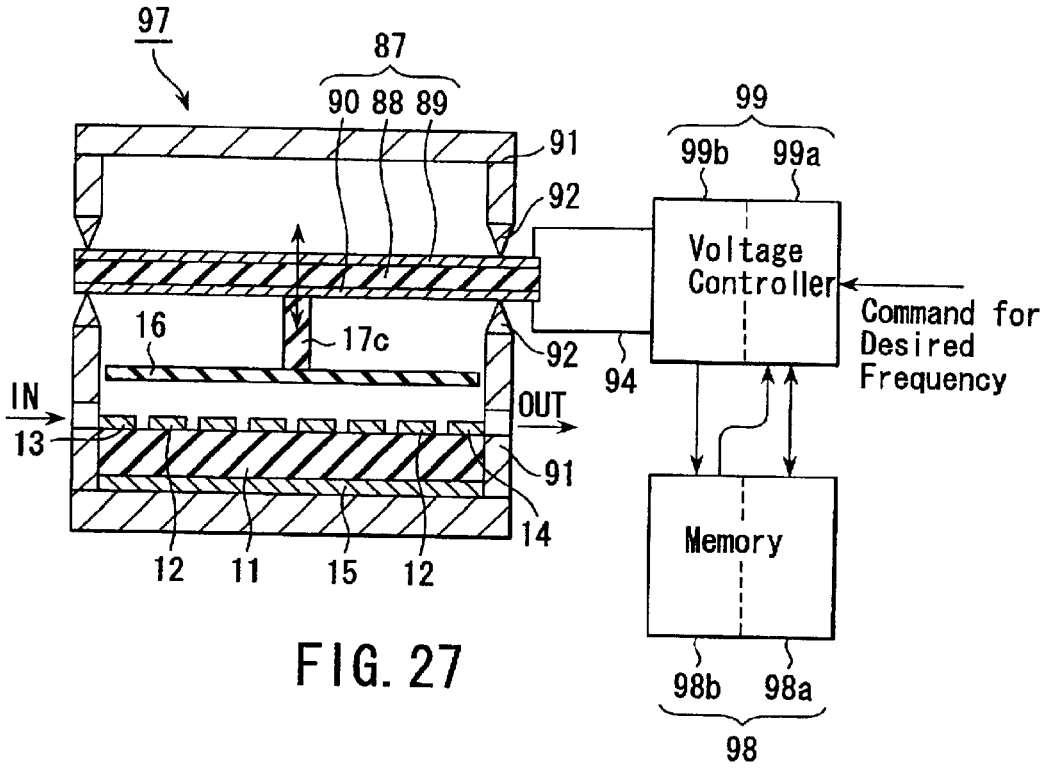
FIG. 27 schematically shows the configuration of a high-frequency device according to an eighth embodiment of the present invention.

FIG. 27 is a block diagram schematically showing the configuration of a high-frequency apparatus according to an eighth embodiment of the present invention. The high-frequency apparatus comprises a frequency variable device (high-frequency device) 97 having the configuration described in the seventh embodiment (see FIG. 21), a memory section 98, and a voltage control section 99.

In the memory section 98, information about a hysteresis loop showing the relationship between the applied voltage to the piezoelectric element in the frequency variable device 97 and the center frequency of the filter is stored in a first memory 98*a* and information about the present operating point (determined by the present applied voltage and the center frequency) on the hysteresis loop is stored in a second memory 98*b*. It is desirable that information about a plurality of hysteresis loops should be stored.

The voltage controller 99, which is composed of a controller 99*a* and a voltage generator 99*b*, determines the change process (or change route) of the applied voltage on the basis of the information stored in the memory 98 in changing the center frequency of the filter and applies the voltage to the piezoelectric element according to the determined change process.

Figure 28:
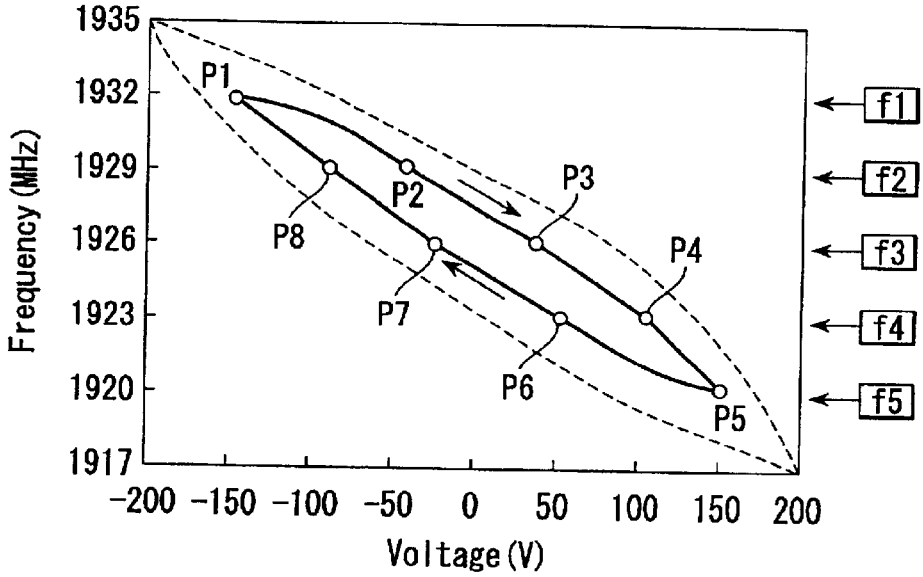
FIG. 28 is a characteristic diagram to help explain the operation of the high-frequency device according to the eighth embodiment.

Next, the operation of the high-frequency apparatus of the eighth embodiment will be explained by reference to FIG. 28. FIG. 28 shows a hysteresis loop for the applied voltage to the piezoelectric element and the center frequency of the filter. As shown in the figure, the route the center frequency takes in raising the voltage differs from the route the center frequency takes in lowering the voltage.

First, a first example of the operation will be explained. In the eighth embodiment, when the center frequency is changed using the same hysteresis loop, the center frequency is so set that it takes the shortest route (or that the shortest time is achieved). Hereinafter, a case where the center frequency is set on the hysteresis loop shown by a solid line in FIG. 28 will be explained.

For instance, consider a case where the present operating point is at P3 (with the center frequency f3) and the center frequency is changed to f2. There are P2 and P8 as operating points corresponding to the center frequency f2. In this case, because of the nature of the hysteresis, the voltage at the operating point P3 cannot be dropped directly to the voltage at the operating point P2 or P8. For this reason, the voltage at the operating point P3 is dropped in such a manner that it passes through the lowest voltage (−150 V) or highest voltage (+150 V) of the hysteresis loop and reaches the voltage at the operating point P2 or P8.

That is, to set the voltage at the operating point P2, the voltage is dropped from point P3 (assumed to be voltage V3) to point P1 (assumed to be voltage V1) temporarily and thereafter raised to point P2 (assumed to be voltage V2). To set the voltage at the operating point P8, the voltage is raised from point P3 (voltage V3) to point P5 (voltage V5) temporarily and thereafter dropped to point P8 (voltage V8). Since the variation in the voltage in the former case is (V3−V1)+(V2−V1) and that in the latter case is (V5−V3)+

(V5–V8), the former is smaller in the variation in the voltage and therefore enables the time required for setting to be made shorter. Accordingly, the voltage controller 99 sets the operating point to P2 (or the voltage of the voltage generator 99*b* to V2), that is, the center frequency to f2.

Now, consider a case where the present operating point is at P2 (the center frequency f2) and the center frequency is changed to f3. There are P3 and P7 as operating points corresponding to the center frequency f3. In this case, to minimize the variation in the voltage, it is apparent that the voltage should be raised from the operating point P2 directly to the operating point P3. When the present operating point is unknown, however, the voltage cannot help being caused to pass through the lowest voltage (−150 V) or the highest voltage (+150 V) of the hysteresis loop and be set to the voltage at the operating point P3 or P7.

In this example of the operation, however, since the second memory 98*b* stores the present operating point P2 (voltage V2), the controller 99*a* gives to the voltage generator 99*b* an instruction to raise the voltage from the present operating point P2 (voltage V2) directly to the operating point P3 (voltage V3) on the basis of information about the hysteresis loop stored in the first memory 98*a*. This makes it possible to set the operating point to P3, or the center frequency to f3.

As described above, because not only the hysteresis loop characteristic but also the operating point currently set is stored, such a route as minimizes the variation in the voltage can be selected, which enables the center frequency to be changed reliably in a short time.

To verify the aforementioned effect, the center frequency was changed 20 times at random using the operating point P3 as the initial state, taking into account five types of center frequencies, f1 to f5, in FIG. 28. As a result, the average required time was about 0.24 millisecond. For comparison's sake, when the voltage was caused never to fail to pass through the lowest voltage or highest voltage on the hysteresis loop and the center frequency was changed 20 times at random, the average required time was about 0.42 millisecond.

Next, a second example of the operation will be explained. In this operation, storing a plurality of hysteresis loops makes it possible to select such a hysteresis loop as minimizes the absolute value of the applied voltage in setting the center frequency. Hereinafter, the operation will be explained concretely by reference to FIG. 28.

For instance, consider a case where the center frequency is set to f4. When the center frequency f4 is set using a hysteresis loop shown by a solid line, P4 (with a voltage of about 100 V) or P6 (with a voltage of about 50 V) becomes an operating point. The application of such a high voltage to the piezoelectric element continuously for a long time is undesirable from the viewpoint of the characteristic and reliability of the element. In this example of the operation, a plurality of hysteresis loops, including the hysteresis loop shown by the solid line and the hysteresis loop shown by a dotted line, are stored in the first memory 98*a*. When the center frequency is set to f4, the hysteresis loop shown by the dotted line is used in place of the hysteresis loop shown by the solid line, which causes the voltage at the operating point (the black point in the figure) corresponding to the center frequency f4 to be set close to 0 V. When the operating point is set by changing another hysteresis loop to the dotted-line hysteresis loop as described above, the voltage is caused to pass through the lowest voltage (−200 V) or the highest voltage (+200 V) of the hysteresis loop and thereafter the operating point is set.

Since, in this example of the operation, a plurality of hysteresis loops have been stored, selecting a suitable hysteresis loop according to the center frequency enables the voltage applied to the piezoelectric element to be made lower.

In the high-frequency devices described in the first to seventh embodiments, the dielectric plate is provided so as to be almost in parallel with the surface of the substrate on which a filter has been formed and further to cover the resonating elements and the gaps between the resonating elements. Adjusting the spacing between the dielectric plate and the substrate on which the filter has been formed enables the transmission characteristic of the filter to be adjusted easily with high accuracy without variations in the skirt characteristics, ripple characteristic, and the like. In addition, with the high-frequency apparatus of the eighth embodiment, the relationship between the voltage applied to the piezoelectric portion and the center frequency corresponding to the applied voltage is stored, which makes it easy to set the optimum center frequency of the high-frequency apparatus easily.

The passing frequency (transmission characteristic), skirt characteristic, ripple characteristic, insertion loss characteristic, and the like of the filter are influenced by the effective permittivity of the medium around the resonating elements. In the present invention, the individual resonating elements and the gaps between the individual resonating elements are covered with the dielectric plate, with the result that the relationship between each resonating element and the dielectric plate and the relationship between the gaps between the individual resonating elements and the dielectric plate are equal. For this reason, the dielectric plate is moved in the direction perpendicular to the surface of the substrate and the spacing between the facing surface of the dielectric plate and the surface of the substrate is changed, while the former is being kept in parallel with the latter. This enables the effective permittivity to change uniformly in each area. Accordingly, the influence of the effective permittivity on each resonating element and that on the coupling between the individual resonating elements can be made equal. This makes it easy to shift the passing frequency of the filter accurately, while maintaining the skirt characteristics, ripple characteristic, and the like of the filter.

In the case of a filter with a large number of frequency adjusting screws on the resonating elements and on the gaps between the resonating elements explained in the prior art, the adjustment of each screw must be made accurately and the position of each screw must be changed according to the pattern of the filter. This makes it very difficult to control the filter characteristic accurately. With the present invention, however, the resonating elements and the gaps between the resonating elements are integral with the dielectric plate and they move as a single unit in making frequency adjustments. This enables the filter characteristics to be controlled easily, regardless of the pattern of the filter.

Next, a device package suitable for the operation of the high-frequency devices explained in the first to seventh embodiments at ultra-low temperature will be explained.

(Ninth Embodiment)

Figure 29:
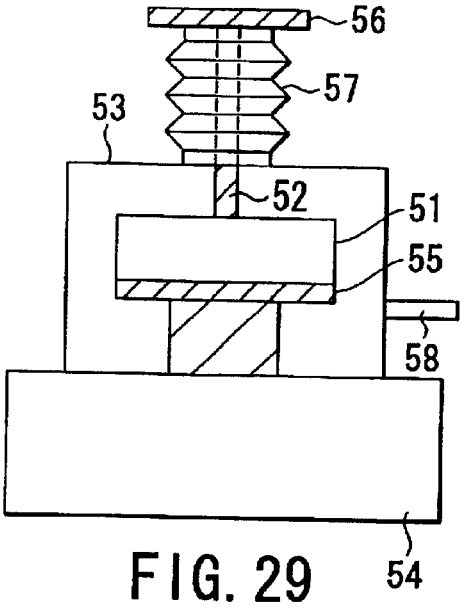
FIG. 29 is a schematic sectional view of a high-frequency device according to a ninth embodiment of the present invention.

FIG. 29 is a sectional view showing an overall configuration of a high-frequency device according to a ninth embodiment of the present invention.

A filter using a superconductor film is used at ultra-low temperatures lower than 77 K. Therefore, it is necessary to combine the filter with a refrigerator. In that case, thermal insulation must be applied. For this reason, it is desirable the filter should be placed in a vacuum. It is necessary to continue evacuating the container with a vacuum pump or hermetically seal the container after evacuating the container. It is important to determine how to move the dielectric plate in such an environment.

In the example of FIG. 29, a member (hereinafter, referred to as an element component member) 51 composed of a dielectric substrate, resonating elements, a ground plane, a dielectric plate, and others as described in each of the aforementioned embodiments is placed on a cold head 55 cooled by a refrigerator 54. A support jig 52 for moving a jig that holds the dielectric plate is provided on a support flange 56. To reduce the power consumption of the refrigerator, it is desirable that the support jig 52 should be made of a material whose thermal conductivity is low, such as metal, ceramic, or resin, or be connected via a member made of one of these materials. The flange 56 is hermetically provided on a vacuum container 53 via bellows 57.

The element component member 51 is set in such an apparatus. The apparatus is then evacuated via an air outlet 58 with a pump (not shown) and hermetically sealed. The dielectric plate is moved by a motor (not shown) or by moving up and down the flange 56 using a bolt or the like. Although not shown in the figure, more than one flange 56 and bellows 57 may be used. In this case, a parallel adjusting jig for the dielectric plate may be moved in a similar manner.

Since this apparatus has no movable part sealed with an O ring or the like, it can be hermetically sealed for a long time.

Figure 30:
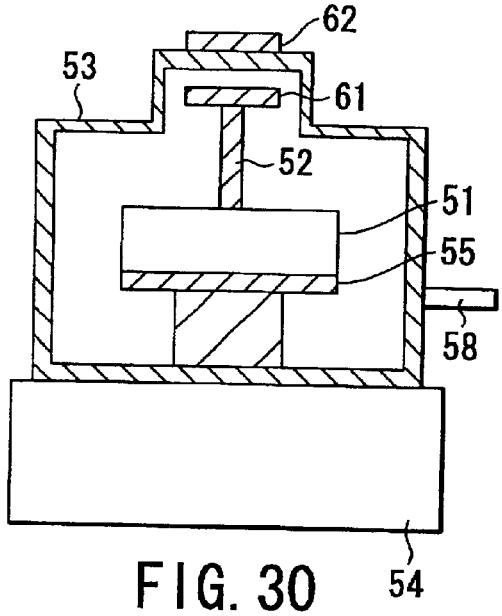
FIG. 30 is a sectional view of a modification of the ninth embodiment.

FIG. 30 shows the configuration of a modification of the apparatus of the ninth embodiment. In this modification, a magnet 61 is provided on the support jig 52 for moving the jig that holds the dielectric plate. A driving magnet 62 (which may be a permanent magnet or electromagnet) faces the magnet 61 with the vacuum container 53 between them. A female thread has been cut in the holding jig for the dielectric plate. The support jig 52 is composed of a bolt in which a mail thread corresponding to the female thread has been cut. The driving magnet 62 is rotated manually or by a motor (not shown), thereby rotating the support jig 52 together with the magnet 61, which enables the holding jig for the dielectric plate to move up and down.

In the configuration of FIG. 30, since the support jig 52 is not connected to the vacuum container 53, the entering of heat can be decreased further.

Figure 31:
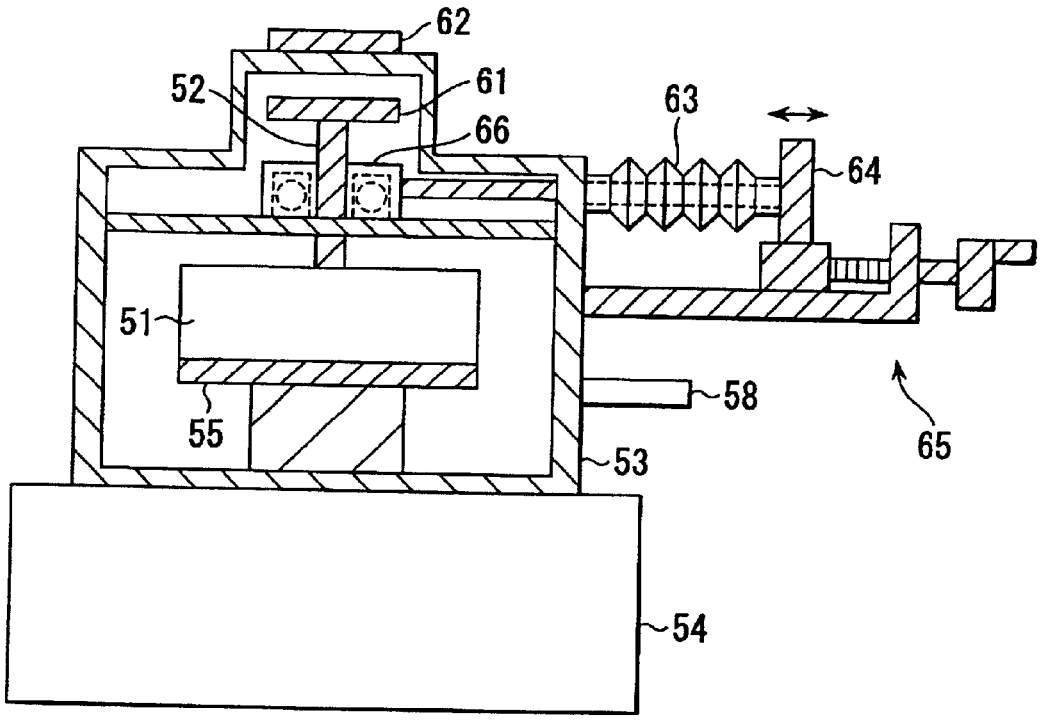
FIG. 31 is a sectional view of another modification of the ninth embodiment.

FIG. 31 shows another modification of the ninth embodiment. In FIG. 31, by using a horizontal movement jig one end of which is provided on the flange 64 connected via bellows 63, a bearing portion 66 supporting the driving bolt 52 is moved in the horizontal direction.

The high-frequency devices explained in the first to eighth embodiments have the configuration suitable for adjusting the center frequency. Now, a high-frequency device (high-frequency filter) which enables not only the center frequency but also the frequency bandwidth to be adjusted easily will be explained.

A communication apparatus for communicating information by wireless or by wire is composed of various devices, including amplifiers, mixers, and filters. A band-pass filter used in this apparatus has a characteristic that permits only the desired band to pass through. The characteristics of the band-pass filter, including the center frequency and bandwidth, are determined according to the specifications of the system. Before explanation of a tenth and later embodiments, the basic configuration of a band-pass filter of the present invention will be explained. The same parts as those in the first to eighth embodiments are indicated by the same reference numerals to make it easy to understand the explanation.

Figure 32A:
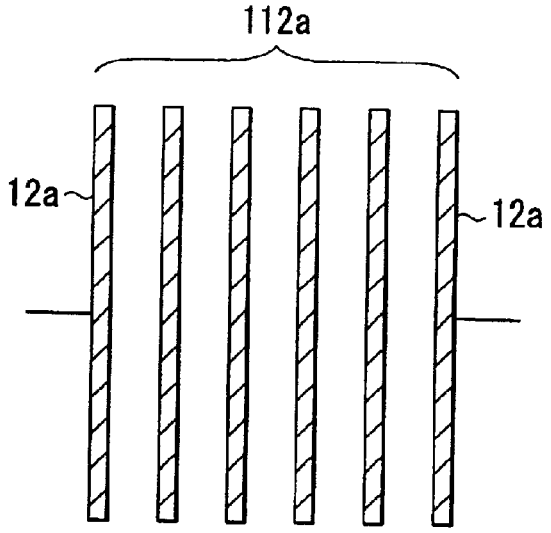
FIGS. 32A to 32C show plane patters of resonating elements in an example of the basic configuration of a band-pass filter related to the embodiments of the present invention.
Figure 32B:
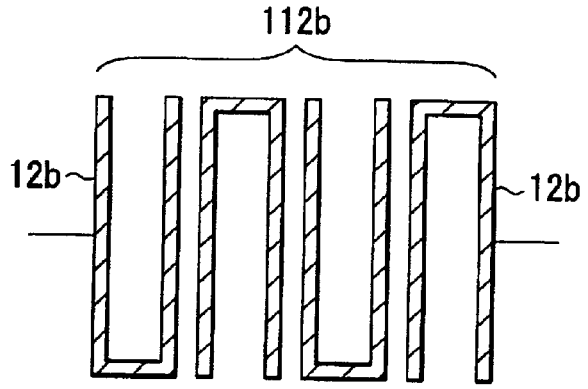
Figure 32C:
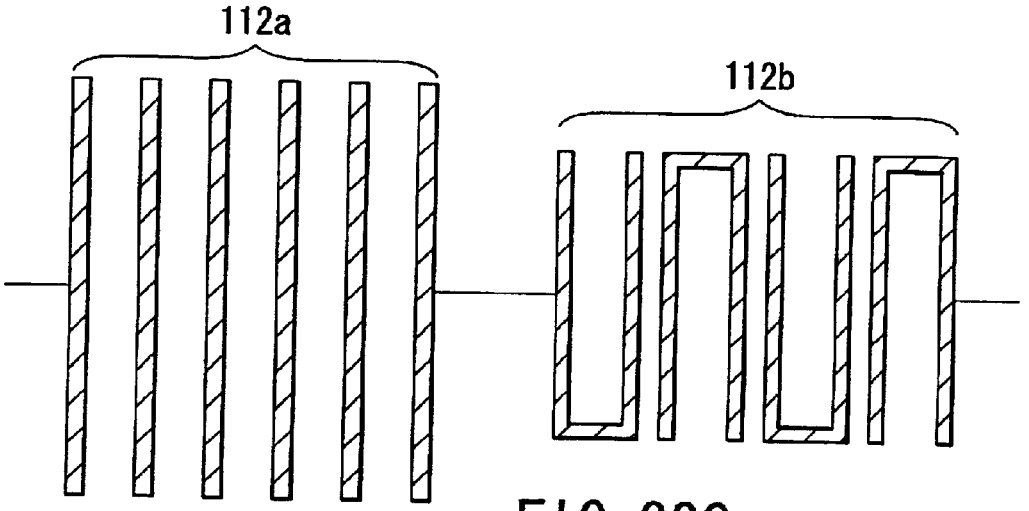

FIGS. 32A to 32C show plane patterns of an example of a band-pass filter according to the embodiments of the present invention. FIG. 32A shows a forward-coupled band-pass filter 112*a*. Specifically, superconductor patters formed on a substrate (not shown) constitute a plurality of resonating elements 12*a*. The plurality of resonating elements 12*a* constitute the band-pass filter 112*a*. The superconductor patterns of the individual resonating elements 12*a* have the same shape and are arranged so as to realize a desired transmission characteristic.

FIG. 32B shows a hairpin band-pass filter 112*b*. The band-pass filter 112*b* is formed in the same manner as the band-pass filter 112*a*. That is, superconductor patters formed on a substrate constitute a plurality of resonating elements 12*b*. The plurality of resonating elements 12*b* constitute the band-pass filter 112*b*. The superconductor patterns of the individual resonating elements 12*b* have the same shape and are arranged so as to realize a desired transmission characteristic.

Figure 33:
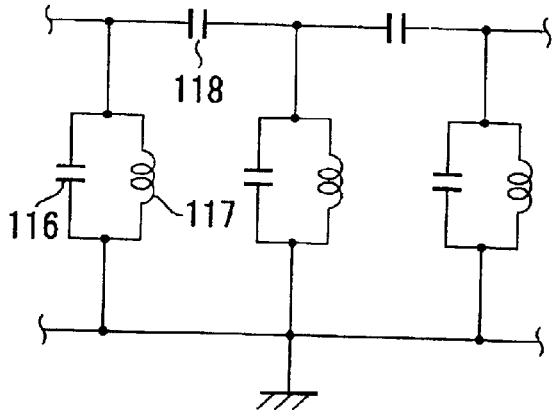
FIG. 33 is an equivalent circuit diagram of the band-pass filter.

A structure as shown in FIG. 32C is obtained by connecting the band-pass filters 112*a* and 112*b* in series. The equivalent circuit of each band-pass filter is as shown in FIG. 33. That is, a parallel circuit of a capacitor 116 and an inductor 117 is connected to another parallel circuit of a capacitor 116 and an inductor 117 via a capacitor 118.

Figure 34A:
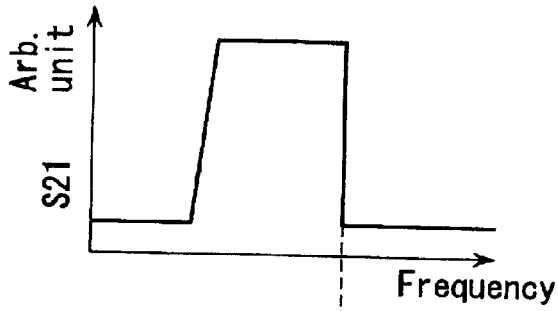
FIGS. 34A to 34C show examples of the transmission characteristics of the band-pass filters shown in FIGS. 32A to 32C.
Figure 34B:
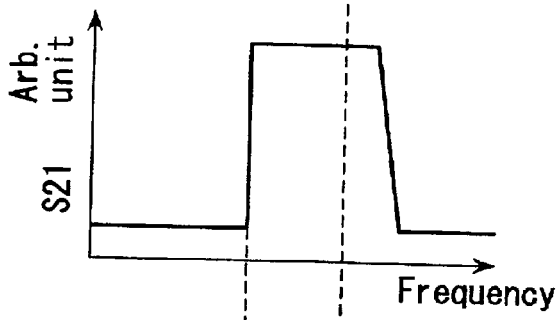
Figure 34C:
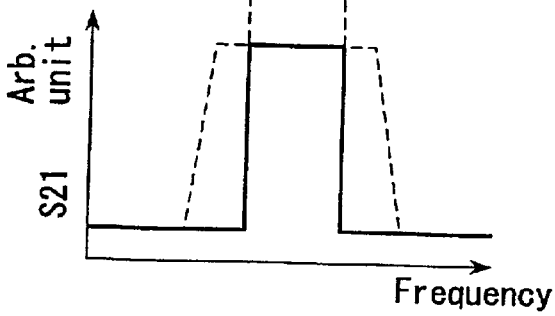

FIGS. 34A to 34C show characteristics of the band-pass filters shown in FIGS. 32A to 32C. The band-pass filter 112*a* of FIG. 32A has a sharp edge on the high-frequency side as shown in FIG. 34A. The band-pass filter 112*b* of FIG. 32B has a sharp edge on the low-frequency side as shown in FIG. 34B. Therefore, with the band-pass filter (see FIG. 32C) obtained by connecting the band-pass filters 112*a* and 112*b* in series, both edges can be made sharp (see FIG. 34C).

Figure 35:
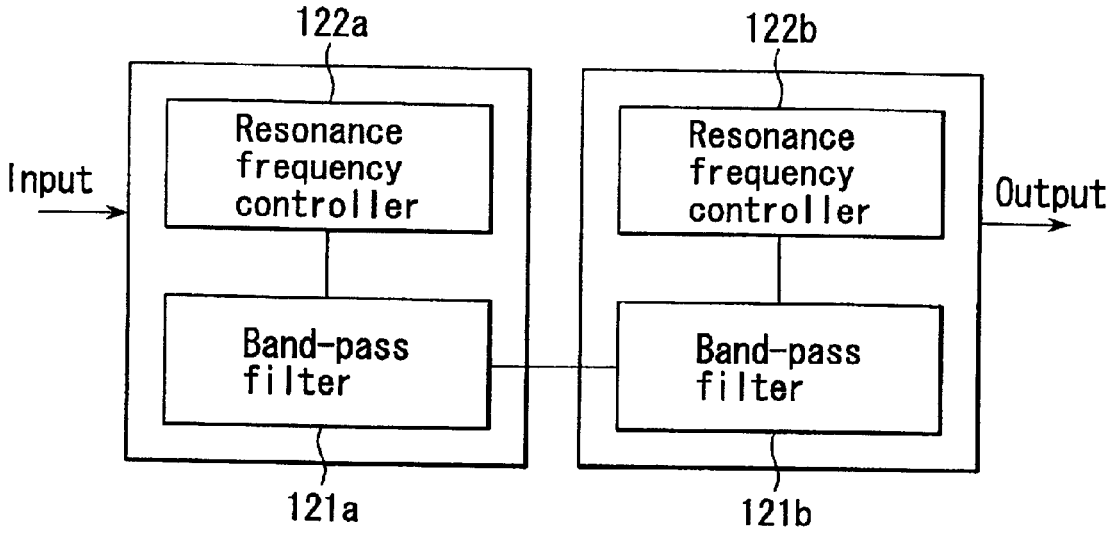
FIG. 35 is a block diagram showing an example of the basic configuration of a filter apparatus related to the embodiments of the present invention.

FIG. 35 shows the basic configuration of a variable frequency filter apparatus according to the ninth embodiment. As shown in the figure, the two band-pass filters 121*a* and 121*b*, which are connected in series, are provided with resonance frequency controllers 122*a* and 112*b*, respectively.

Figure 36:
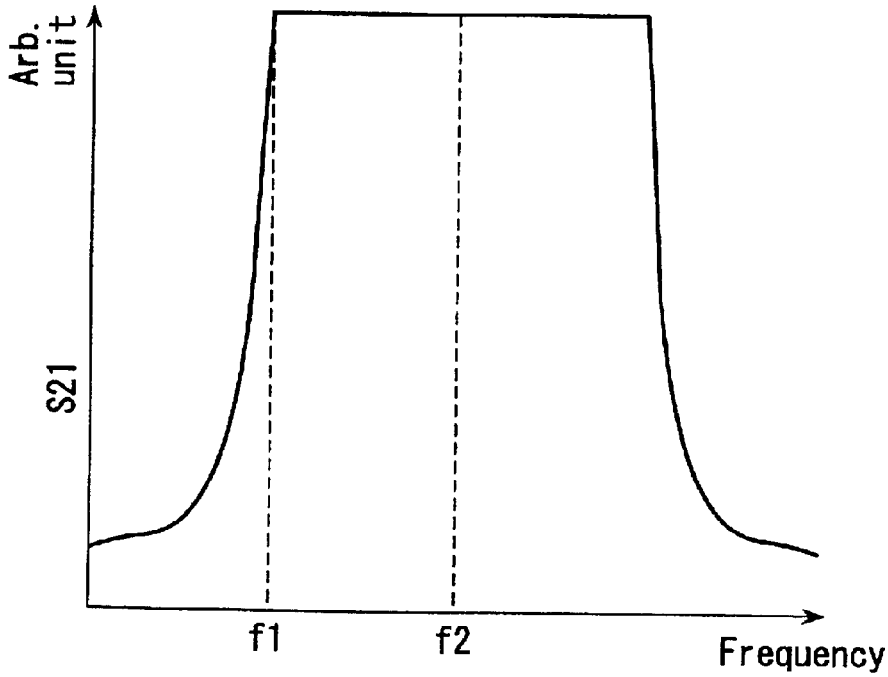
FIG. 36 shows a transmission characteristic of the front-stage band-pass filter in the embodiments of the present invention.
Figure 37:
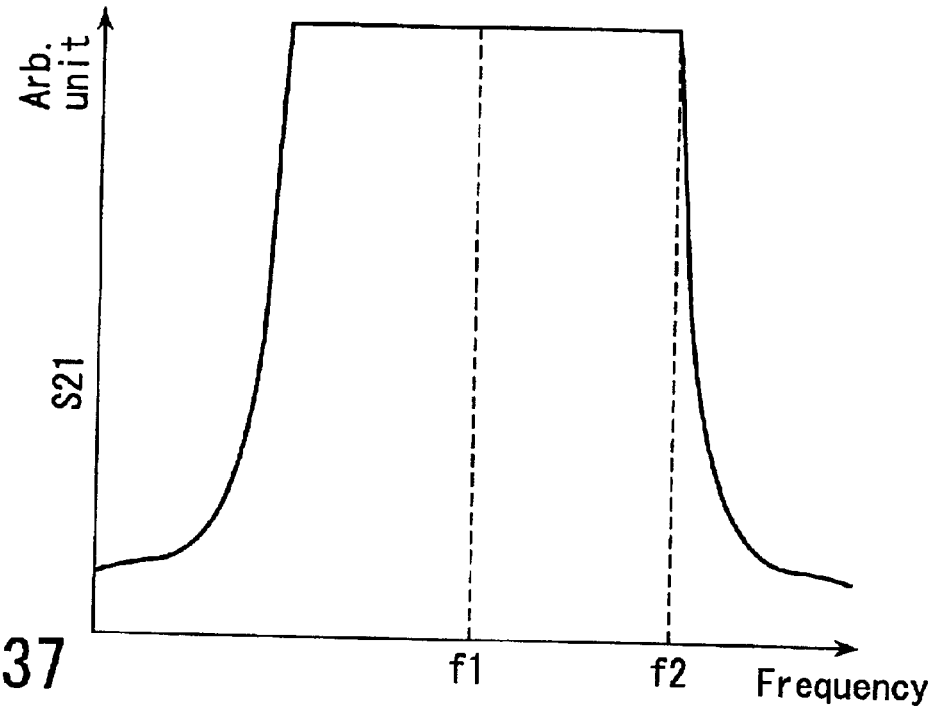
FIG. 37 shows a transmission characteristic of the back-stage band-pass filter in the embodiments of the present invention.
Figure 38:
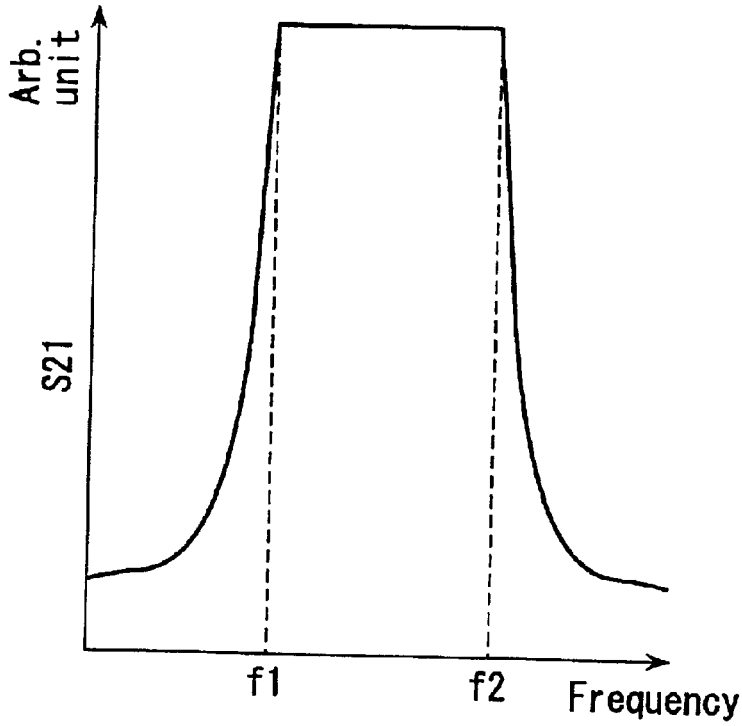
FIG. 38 shows a transmission characteristic of a band-pass filter whose front-stage and back stage are connected in series in the embodiments of the present invention.

FIG. 36 shows a transmission characteristic of only the band-pass filter 121*a* when the passing frequency of the band-pass filter 121*a* is not changed by the resonance frequency controller 122*a*. Similarly, FIG. 37 shows a transmission characteristic of only the band-pass filter 121*b* when the passing frequency of the band-pass filter 121*b* is not changed by the resonance frequency controller 122*b*. In the figure, f1 indicates the low-frequency side end of the passband for the band-pass filter 121*a* alone and f2 indicates the high-frequency side end of the passband for the band-pass filter 121*b* alone. FIG. 38 shows a transmission characteristic of the entire filter circuit of FIG. 35. The filter circuit of FIG. 35 functions as a band-pass filter that selectively permits the frequencies ranging from f1 to f2 to pass through.

Figure 39:
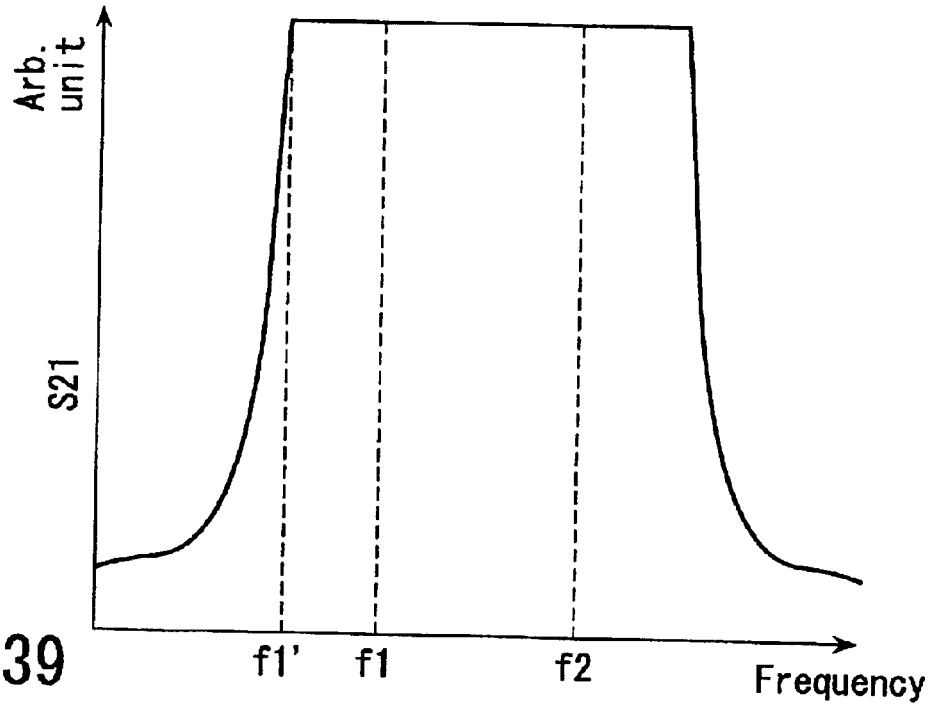
FIG. 39 shows a transmission characteristic of the front-stage band-pass filter in the embodiments of the present invention when the center frequency has been adjusted.

FIG. 39 shows a transmission characteristic of only the band-pass filter 121*a* when the resonance frequencies of the resonating elements constituting the band-pass filter 121*a* are controlled using the resonance frequency controller 122*a*, thereby changing the passing frequency of the band-pass filter 121*a*. In this case, the whole passband has shifted toward the low-frequency side as compared with FIG. 36 and the low-frequency side end of the passband is f1'.

Figure 40:
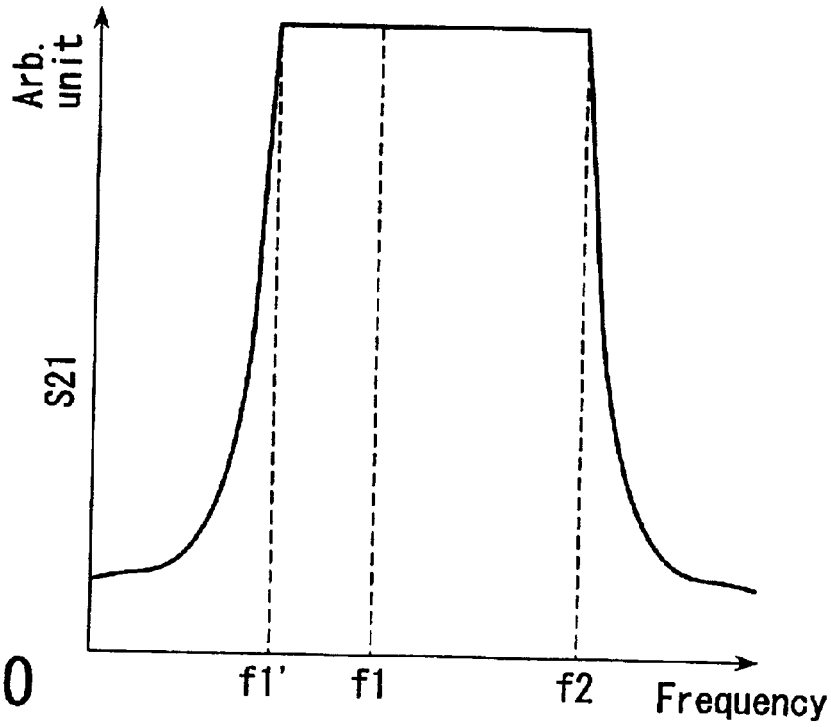
FIG. 40 shows a transmission characteristic of a band-pass obtained by connecting the band-pass filter of FIG. 39 and the band-pass filter of FIG. 37 in series.

FIG. 40 shows a transmission characteristic of the entire filter circuit of FIG. 35 when the passing frequency of the band-pass filter 121*a* alone is controlled as shown in FIG. 39. The filter circuit of FIG. 35 functions as a band-pass filter that permits the frequencies ranging from f1' to f2 on the whole to pass through and has a greater bandwidth than that in the transmission characteristic of FIG. 38 with no frequency control.

By shifting the entire passband of the band-pass filter 121*a* toward the high-frequency side using the resonance frequency controller 122*a*, the passing bandwidth of the entire filter circuit of FIG. 35 can be narrowed in the same manner.

Furthermore, by changing the passing frequency of the band-pass filter 121*b* using the resonance frequency controller 122*b*, the passing frequency of the entire filter circuit of FIG. 35 can be controlled to a desired value in a similar manner. In addition to using either the resonance frequency controller 122*a* or 112*b*, both of them may be used simultaneously.

As described above, the resonance frequencies of the resonating elements constituting either or both of the band-pass filters are controlled by the resonance frequency controllers, thereby controlling the center frequency of the filter. This makes it possible to control the filter characteristics, including the center frequency and bandwidth of the entire series-connected filer circuit, so as to achieve the desired characteristics.

Hereinafter, concrete embodiments of the present invention will be explained.

(Tenth Embodiment)

Figure 41:
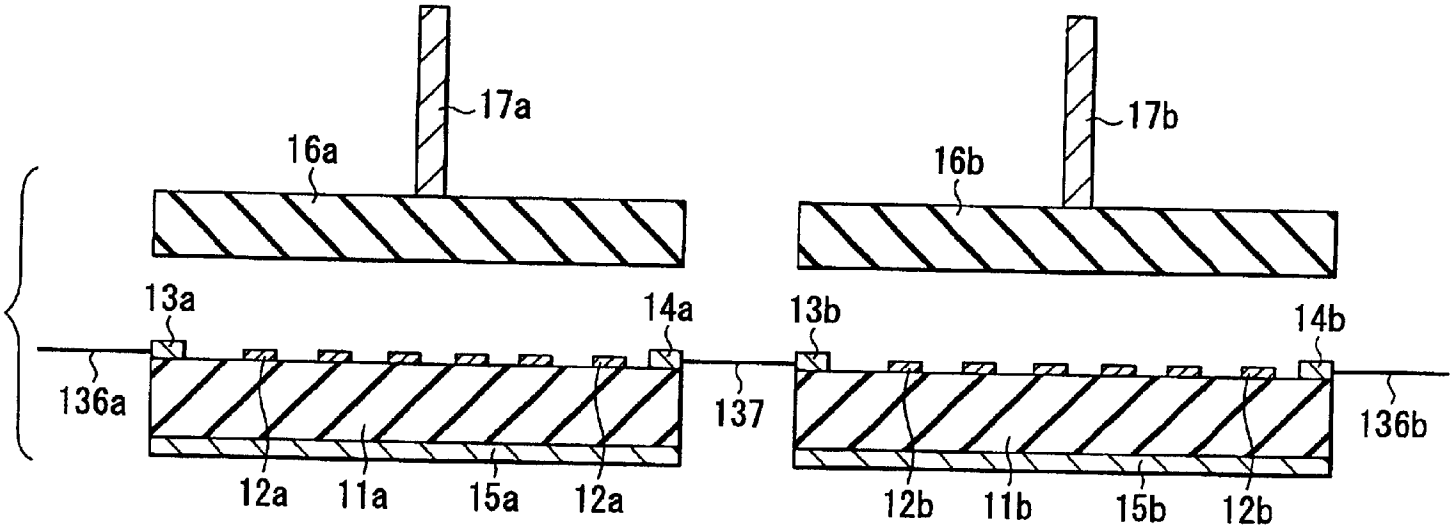
FIG. 41 is a sectional view of a filter apparatus according to a tenth embodiment of the present invention.

FIG. 41 is a schematic sectional view of a high-frequency device according to a tenth embodiment of the present invention.

A first band-pass filter component section is composed of a dielectric substrate 11*a*, a ground plane 15*a* made of a superconductor film on the bottom surface of the dielectric substrate 11*a*, a plurality of resonating elements 12*a* made of a superconductor film on the top surface of the dielectric substrate 11*a*, an input port 13*a*, and an output port 14*a*. Similarly, a second band-pass filter component section is composed of a dielectric substrate 11*b*, a ground plane 15*b* made of a superconductor film on the bottom surface of the dielectric substrate 11*b*, a plurality of resonating elements 12*b* made of a superconductor film on the top surface of the dielectric substrate 11*b*, an input port 13*b*, and an output port 14*b*. Both of the first and second band-pass filters are of the microstrip line type. For instance, the band-pass filters as shown in FIGS. 32A and 32B may be used as the first and second band-pass filters.

A coaxial line 136*a* is connected to the input port 13*a* of the first band-pass filter 13*a* and a coaxial line 136*b* is connected to the output port 14*b* of the second band-pass filter. The output port 14*a* of the first band-pass filter is connected to the input port 13*b* of the second band-pass filter with a connection wire 137.

A dielectric plate 16*a* and a spacing adjusting member 17*a* are provided as means for controlling the passing frequency of the first band-pass filter. The spacing adjusting member 17*a* is designed to move up and down in such a manner that the dielectric plate 16*a* and dielectric substrate 11*a* keep in parallel with each other. Similarly, a dielectric plate 16*b* and a spacing adjusting member 17*b* are provided for controlling the passing frequency of the second band-pass filter.

In the first band-pass filter, the dielectric plate 16*a* is provided so as to cover all the plurality of resonating elements 12*a*. The spacing adjusting member 17*a* is moved up and down in such a manner that the surface of the dielectric plate 16*a* and the surface of the dielectric substrate 11*a* are kept in parallel with each other, thereby controlling the distance between the dielectric plate 16*a* and the resonating elements 1*a*. The same holds true for the second band-pass filter.

As in the first embodiment, various dielectric materials, such as sapphire ($Al_2O_3$), MgO, or $LaAlO_3$, may be used as the dielectric plates 16*a* and 16*b*. It is desirable that the dielectric loss factor of the dielectric material should be as low as possible. The same dielectric materials may be used as the dielectric substrates 11*a* and 11*b*.

Furthermore, a YBCO (an alloy of yttrium, barium, copper, and oxygen) superconductor film formed by laser ablation techniques, sputtering techniques, co-evaporation techniques, or the like or the materials described in the first embodiment may be used as materials for the resonating elements (microstrip lines) 12*a* and 12*b*.

The position of the spacing adjusting members 17*a* and 17*b* is controlled by just using screws. Instead of the screws, various types of actuators, such as piezoelectric elements, may be used as in the seventh and eighth embodiment. Moreover, the various types of filter configurations explained in the first to seventh embodiments may be applied to the tenth embodiment.

As described above, in the tenth embodiment, moving up and down the spacing adjusting member 17*a* (or 17*b*) enables the distance between the dielectric plate 16*a* (or dielectric plate 16*b*) and the resonating elements 12*a* (or resonating elements 12*b*) to be controlled, thereby making it possible to change the frequency characteristic of the first or second band-pass filter.

Furthermore, the dielectric plate is provided so as to cover the superconductor patterns of the resonating elements and the spacing adjusting member is moved up and down in such a manner that the dielectric plate and the surface of the substrate are kept in parallel with each other. This makes it possible to change the resonance frequencies of the individual resonating elements uniformly.

In this case, if the frequency adjusting range is not large, there is no need to adjust the coupling of the resonating elements separately. That is, even when the frequencies of both band-pass filters connected in series are controlled, the number of control parameters is two at most in adjusting the spacing adjusting member of each band-pass filter and does not depend on the number of stages of filters (resonating elements) included in each dielectric substrate. Accordingly, it is possible to realize a variable characteristic band-pass filter with a sharp skirt characteristic easily.

(Eleventh Embodiment)

Figure 42:
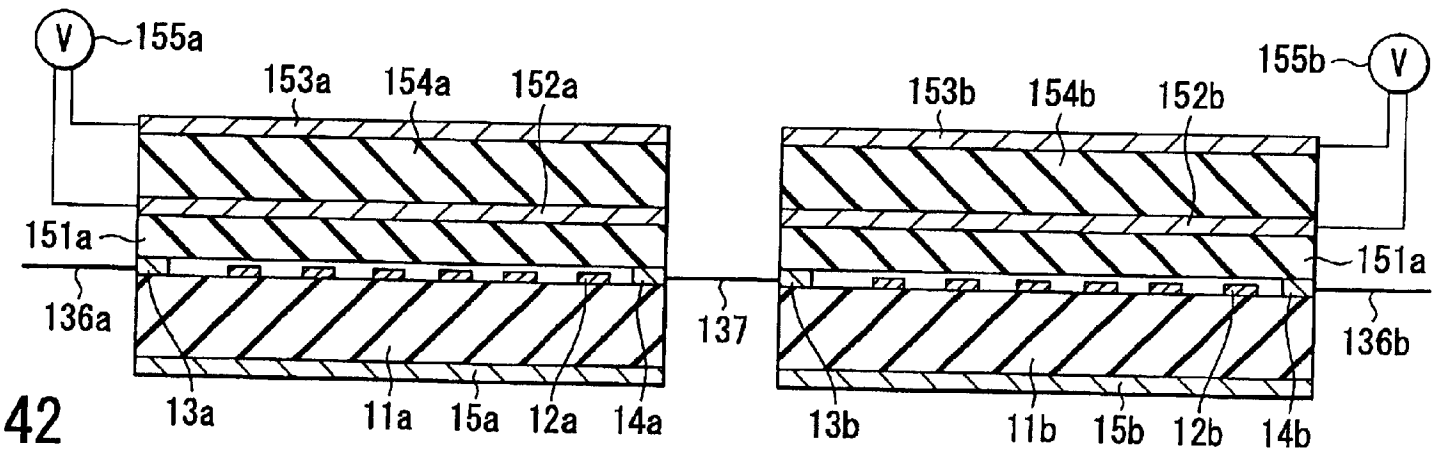
FIG. 42 is a sectional view of a filter apparatus according to an eleventh embodiment of the present invention.

FIG. 42 is a schematic sectional view of a high-frequency device according to an eleventh embodiment of the present invention.

The basic configuration of the first and second band-pass filter component sections, input and output ports, and others are the same as that of the tenth embodiment shown in FIG. 41. The component parts corresponding to those in FIG. 41 are indicated by the same reference numerals and a detailed explanation of them will be omitted.

In the eleventh embodiment, a capacitor structure formed on an insulating dielectric 151*a* is provided for controlling the passing frequency of the first band-pass filter. The capacitor structure is such that a dielectric 154*a* is sandwiched between electric-field-applying electrodes 152*a* and

153*a*. The dielectric 154*a* is made of a material whose permittivity varies with the applied voltage.

Similarly, to control the passing frequency of the second band-pass filter, there are provided an insulating dielectric 151*b*, electric-field-applying electrodes 152*b* and 153*b*, and a dielectric 154*b*.

For example, in the first band-pass filter, the insulating dielectric 151*a*, electric-field-applying electrodes 152*a* and 153*a*, and dielectric 154*a* are so provided that they cover all of the plurality of resonating elements 12*a*. An electric-field-applying (or a voltage-applying) power supply 155*a* changes the voltage to be applied to the electric-field-applying electrodes 152*a* and 153*a*, thereby controlling the electric field applied to the dielectric 154*a*. The same holds true for the second band-pass filter.

$SrTiO_3$ or $Ba_xSr_{1-x}TiO_3$ (where x is the amount of replacement of Sr by Ba and has a value of 1 or less) or a material obtained by subjecting these materials to doping to increase the amount of change in the permittivity may be used for the dielectrics 154*a* and 154*b*.

As described above, with the eleventh embodiment, the dielectric 154*a* (or dielectric 154*b*) whose permittivity varies with the applied electric field is provided and the power supply 155*a* (or power supply 155*b*) controls the applied electric field, thereby changing the transmission characteristics of the first and second band-pass filters. Furthermore, the dielectric is provided so as to cover the superconductor patterns of the resonating elements, enabling the resonance frequencies of the individual resonating elements to be changed uniformly, which makes it possible to realize a variable characteristic band-pass filter with a sharp skirt characteristic as in the tenth embodiment.

(Twelfth Embodiment)

Figure 43:
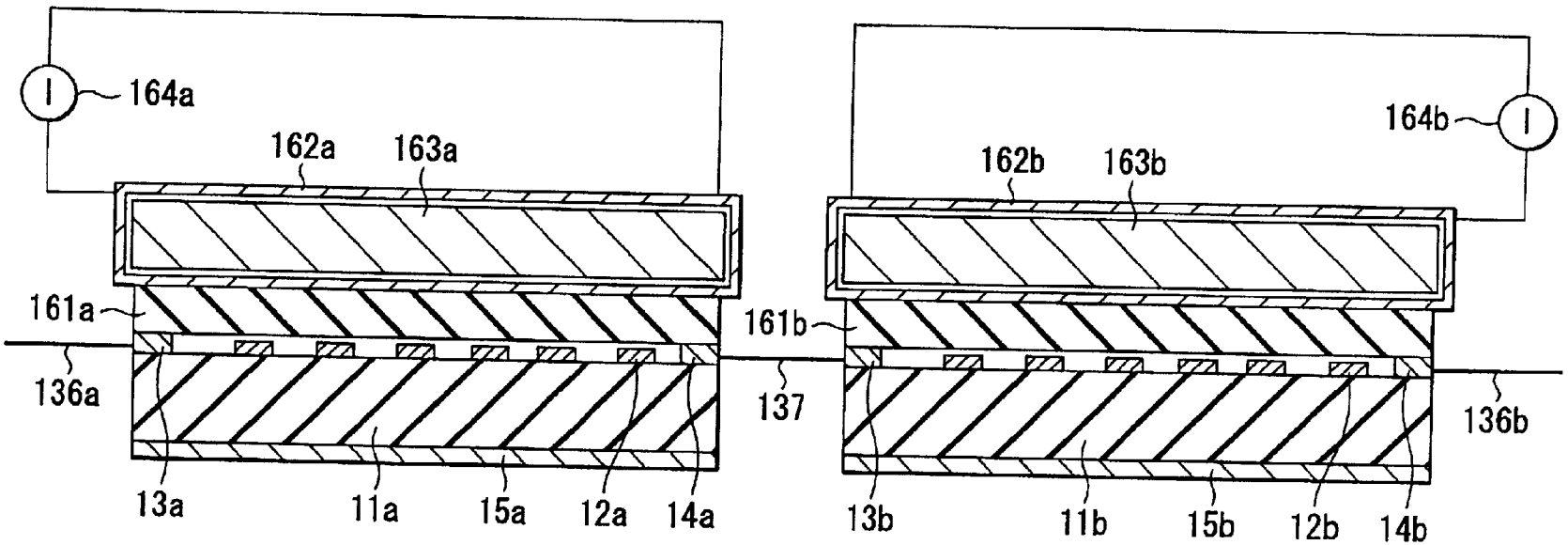
FIG. 43 is a sectional view of a filter apparatus according to a twelfth embodiment of the present invention.

FIG. 43 is a schematic sectional view of a high-frequency device according to a twelfth embodiment of the present invention.

The basic configuration of the first and second band-pass filter component sections, input and output ports, and others are the same as that of the tenth embodiment shown in FIG. 41. The component parts corresponding to those in FIG. 41 are indicated by the same reference numerals and a detailed explanation of them will be omitted.

In the twelfth embodiment, an inductor structure formed on an insulating dielectric 161*a* is provided for controlling the passing frequency of the first band-pass filter. The inductor structure is such that a magnetic material 163*a* is provided in a magnetic-field-applying coil 162*a*. A material whose permeability varies with the applied magnetic filed is used as the magnetic material 163*a*. Similarly, to control the frequency of the second band-pass filter, there are provided an insulating dielectric 161*b*, a magnetic-field-applying coil 162*b*, and a magnetic material 163*b*.

For example, in the first band-pass filter, the insulating dielectric 161*a*, magnetic-field-applying coil 162*a*, and magnetic material 163*a* are so provided that they cover all of the plurality of resonating elements 12*a*. A magnetic-field-applying (or a current-supplying) power supply 164*a* changes the current to be supplied to the magnetic-field-applying coil 162*a*, thereby controlling the magnetic field applied to the magnetic material 163*a*. The same holds true for the second band-pass filter.

Such a material as $Y_3Fe_5O_{12}$ may be used as the magnetic materials 163*a* and 163*b*.

As described above, with the twelfth embodiment, the magnetic material 163*a* (or magnetic material 163*b*) whose permeability varies with the applied magnetic field is provided and the power supply 164*a* (or power supply 164*b*) controls the applied magnetic field, thereby changing the transmission characteristics of the first and second band-pass filters.

Furthermore, the magnetic material is provided so as to cover the superconductor patterns of the resonating elements, enabling the resonance frequencies of the individual resonating elements to be changed uniformly, which makes it possible to realize a variable characteristic band-pass filter with a sharp skirt characteristic as in the tenth embodiment.

(Thirteenth Embodiment)

Figure 44:
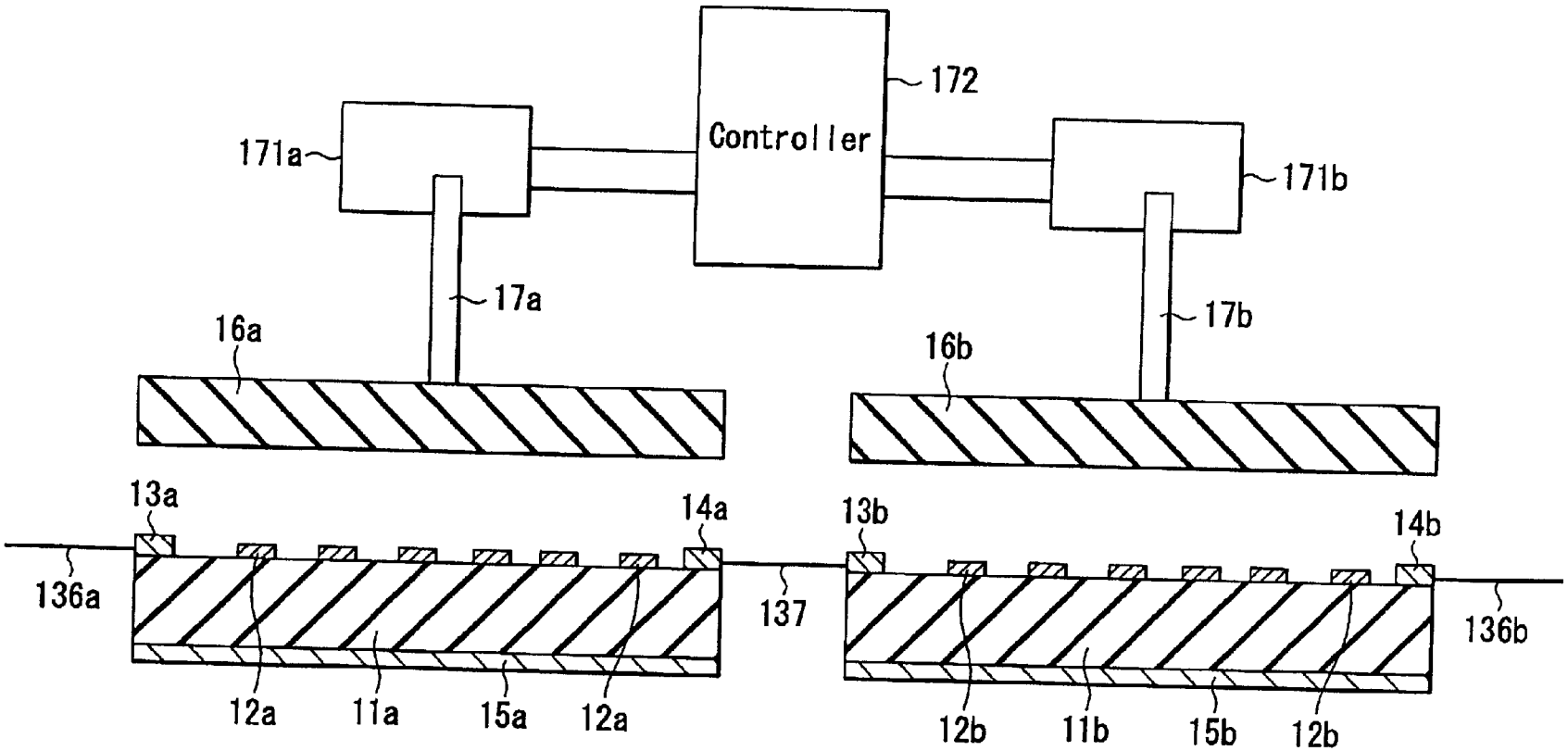
FIG. 44 is a sectional view of a filter apparatus according to a thirteenth embodiment of the present invention.

FIG. 44 is a schematic sectional view of a high-frequency device according to a thirteenth embodiment of the present invention. The basic configuration of the thirteenth embodiment is the same as that of the tenth embodiment shown in FIG. 41. The component parts corresponding to those in FIG. 41 are indicated by the same reference numerals.

In the thirteenth embodiment, actuators 171*a* and 171*b* for controlling the spacing adjusting members 17*a* and 17*b*, respectively, are connected to a controller 172. The controller 172 controls at least one of the spacing adjusting members 17*a* and 17*b* every moment.

(Fourteenth Embodiment)

Figure 45:
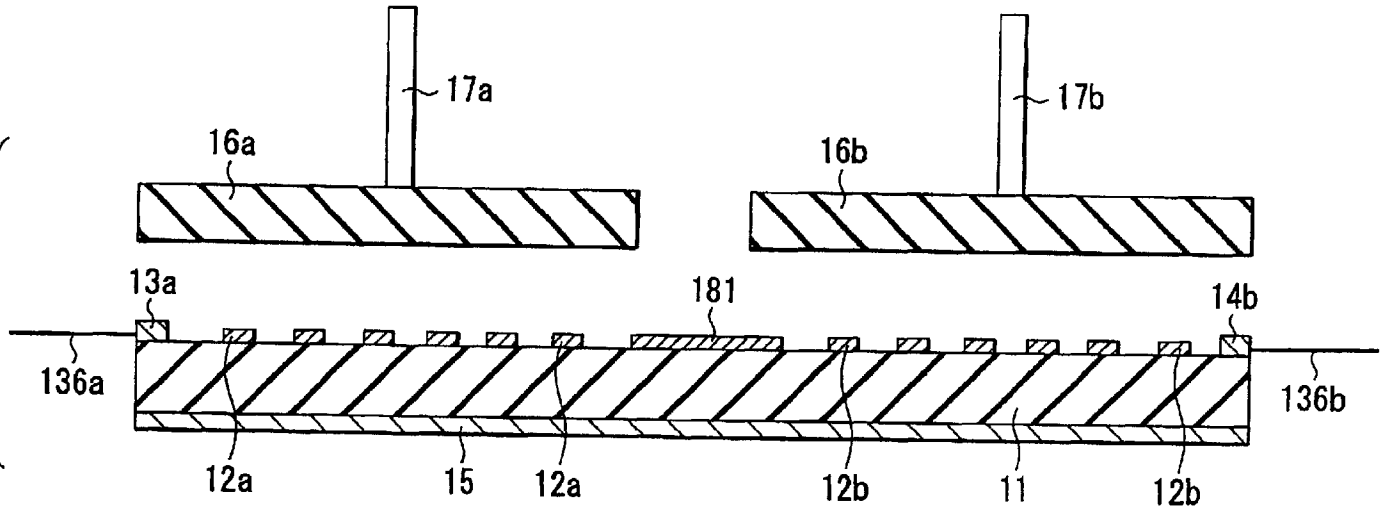
FIG. 45 is a sectional view of a filter apparatus according to a fourteenth embodiment of the present invention.

FIG. 45 is a schematic sectional view of a high-frequency device according to a fourteenth embodiment of the present invention. The basic configuration of the fourteenth embodiment is the same as that of the tenth embodiment shown in FIG. 41. The component parts corresponding to those in FIG. 41 are indicated by the same reference numerals.

In the tenth embodiment, band-pass filters have been constructed using separate substrates. In the fourteenth embodiment, however, resonating elements 12*a* and 12*b* are formed on the same dielectric substrate 11, thereby constructing a first and a second band-pass filter using the same substrate. The first and second band-pass filters are connected to each other with a transmission line 181 formed on the dielectric substrate 11.

The means for controlling the frequency of the band-pass filter may be what has been explained in the eleventh or twelfth embodiment.

(Fifteenth Embodiment)

Figure 46:
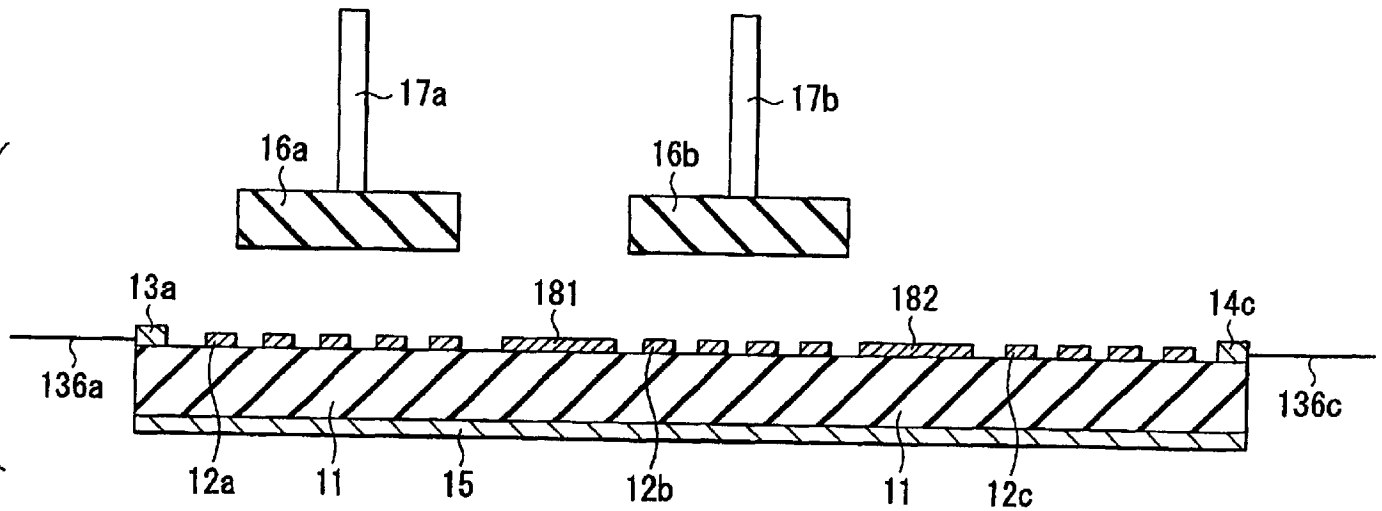
FIG. 46 is a sectional view of a filter apparatus according to a fifteenth embodiment of the present invention.

FIG. 46 is a schematic sectional view of a high-frequency device according to a fifteenth embodiment of the present invention. The basic configuration of the fifteenth embodiment is the same as that of the fourteenth embodiment shown in FIG. 45. The component parts corresponding to those in FIG. 45 are indicated by the same reference numerals.

While in the fourteenth embodiment, the first and second band-pass filters have been connected in series using the same dielectric substrate, a third band-pass filter is further connected in series using the same dielectric substrate in the fifteenth embodiment. Specifically, resonating elements 12*a*, 12*b*, and 12*c* are formed on the same dielectric substrate 11. The first and second band-pass filters are connected to each other with a transmission line 181 and the second and third band-pass filters are connected to each other with a transmission line 182. A coaxial line 136*c* is connected to the output port 14*c* of the third band-pass filter.

The number of band-pass filters connected in series may be increased further. In addition, the means for controlling the frequency of the band-pass filter may be what has been explained in the eleventh or twelfth embodiment.

(Sixteenth Embodiment)

Figure 47A:
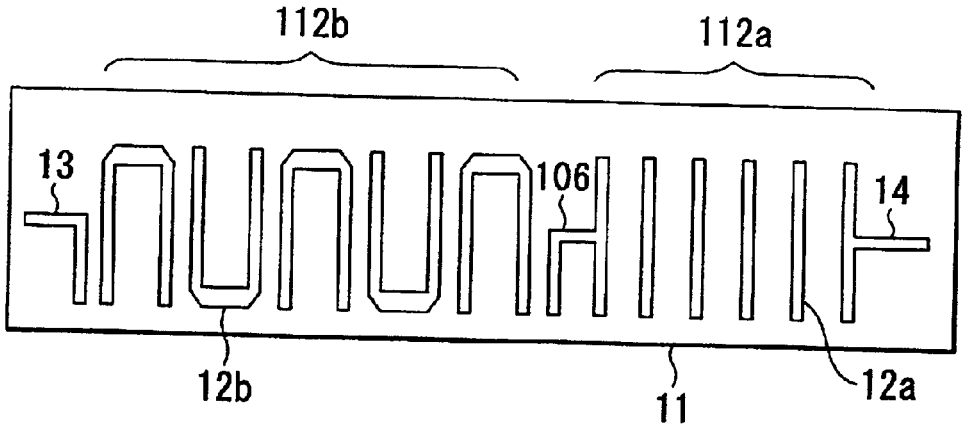
FIGS. 47A and 47B show the main configuration of a filter apparatus according to a sixteenth embodiment of the present invention and its filter characteristic, respectively.
Figure 47B:
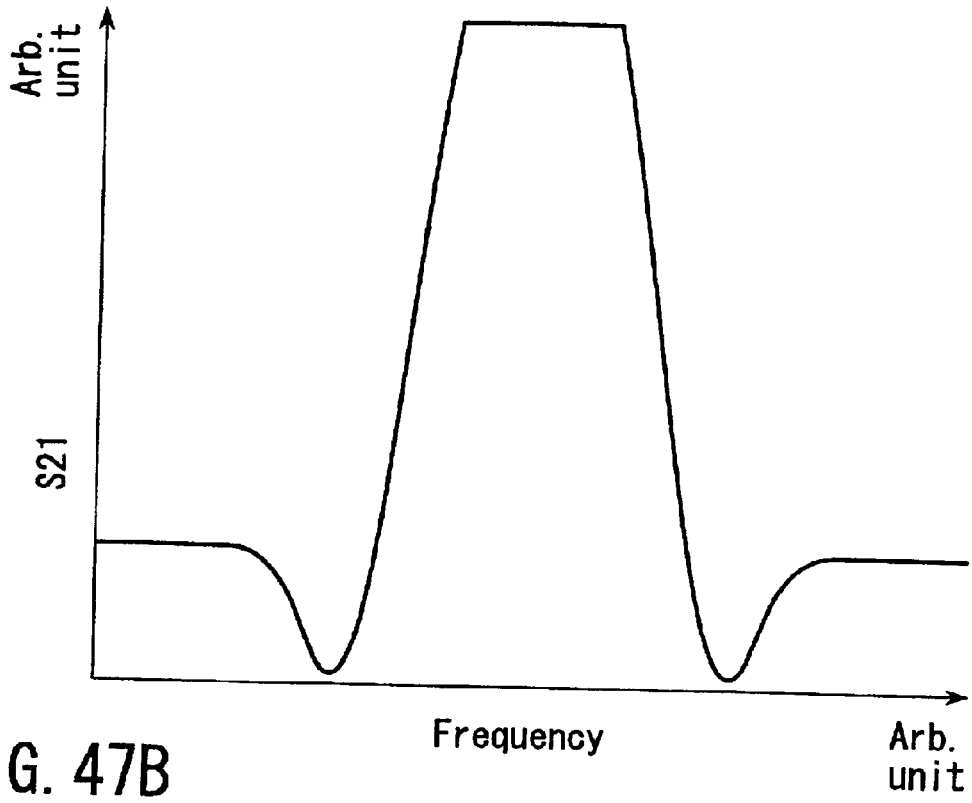

FIGS. 47A and 47B are related to a high-frequency device according to a sixteenth embodiment of the present invention. FIG. 47A is a plan view showing the arrangement of band-pass filters. FIG. 47B shows a transmission characteristic of the band-pass filters.

As shown in FIG. 47A, the band-pass filter is such that a forward-coupled 6-stage band-pass filter 112*a* composed of resonating elements 12*a* and a 5-stage band-pass filter 112*b* composed of resonating elements 12*b* are formed on the same substrate 101, with the 6-stage band-pass filter and the 5-stage band-pass filter connected in series through a connecting portion 106. An input terminal 13 and an output terminal 14 are connected to the band-pass filter 112*b* and band-pass filter 112*a*, respectively.

As shown in FIG. 47B, this band-pass filter realizes a sharp skirt characteristic that has poles on both sides of the passband.

(Seventeenth Embodiment)

Figure 48A:
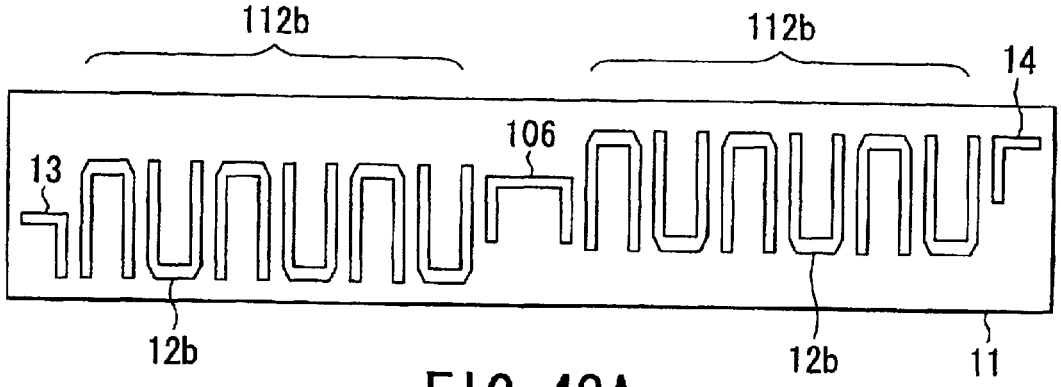
FIGS. 48A and 48B are a plan view of a filter apparatus according to a seventeenth embodiment of the present invention and a plan view of a comparative example, respectively.
Figure 48B:
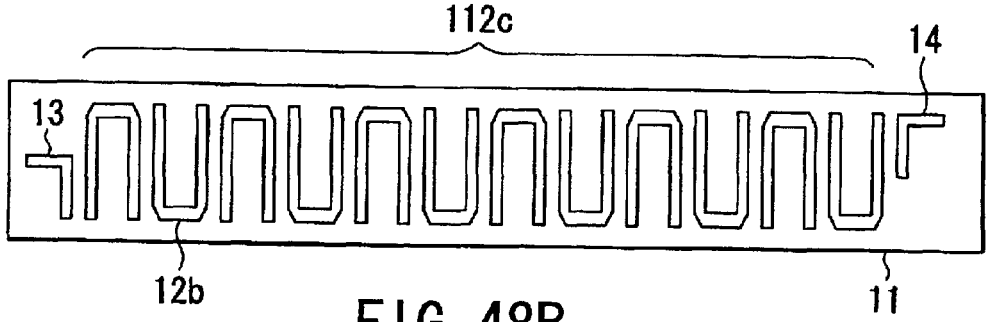
Figure 48C:
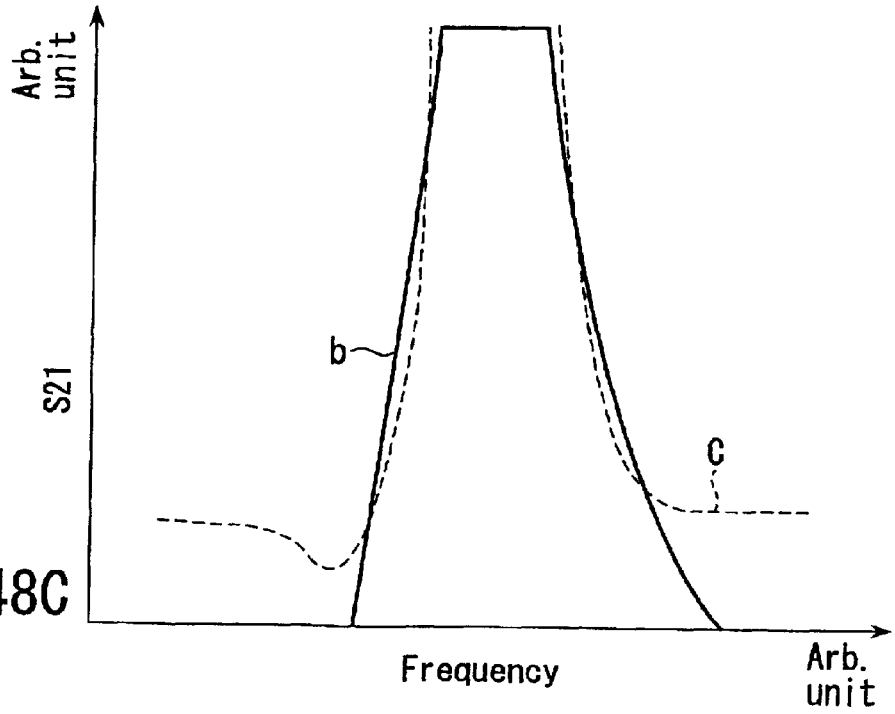
FIG. 48C shows filter characteristics of the seventeenth embodiment and the comparative example.

FIGS. 48A to 48C are related to a high-frequency device according to a seventeenth embodiment of the present invention. FIG. 48A is a plan view showing the arrangement of band-pass filters related to the seventeenth embodiment. FIG. 48B is a plan view showing the arrangement of band-pass filters related to a comparative example. FIG. 48C shows a transmission characteristic (indicated by b) of the band-pass filter of FIG. 48A and that (indicated by c) of the band-pass filter of FIG. 48B. The component parts corresponding to those in the sixteenth embodiment shown in FIG. 47A are indicated by the same reference numerals.

The band-pass filter (see FIG. 48A) of the seventeenth embodiment is such that two units of the band-pass filter 112*b* (of a 6-stage structure) are connected in series on the same substrate 101. The comparative example (see FIG. 48B) shows a 12-stage band-pass filter 112*c* composed of the same resonating elements as the resonating elements 12*b* shown in FIG. 48A.

As shown in FIG. 48C, a skirt characteristic (shown by a solid line b) of the band-pass filter 112*b* of the seventeenth embodiment is in no way inferior to a skirt characteristic (shown by a dotted line c) of the band-pass filter 112*c* in the comparative example. In addition, the amount of attenuation outside the passband in the seventeenth embodiment is greater than that in the comparative example.

(Eighteenth Embodiment)

Figure 49A:
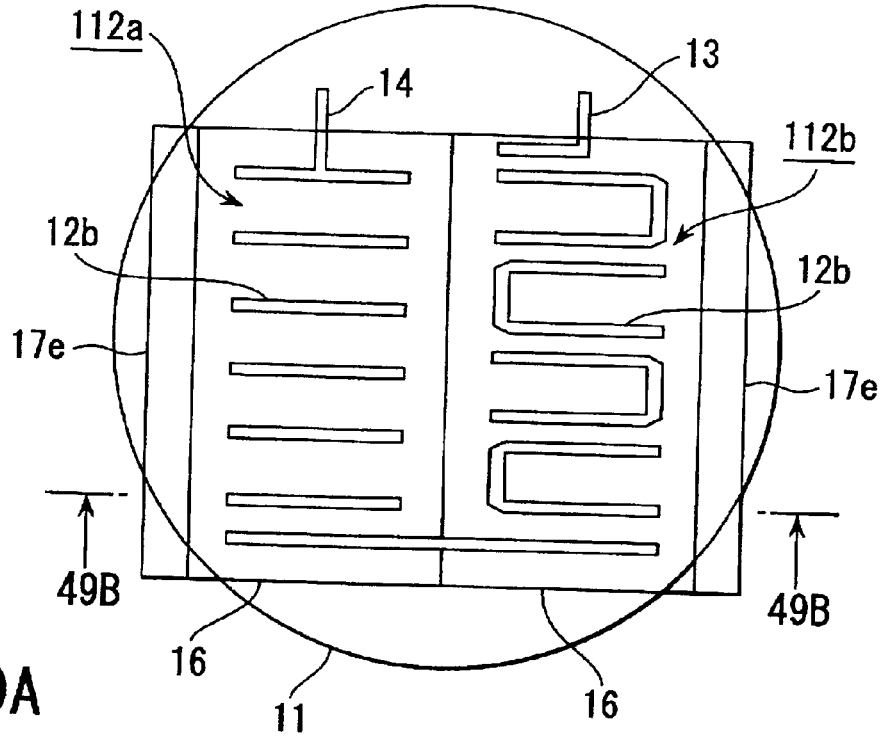
FIGS. 49A and 49B are a plan view and sectional view of a filter apparatus according to an eighteenth embodiment of the present invention, respectively.
Figure 49B:
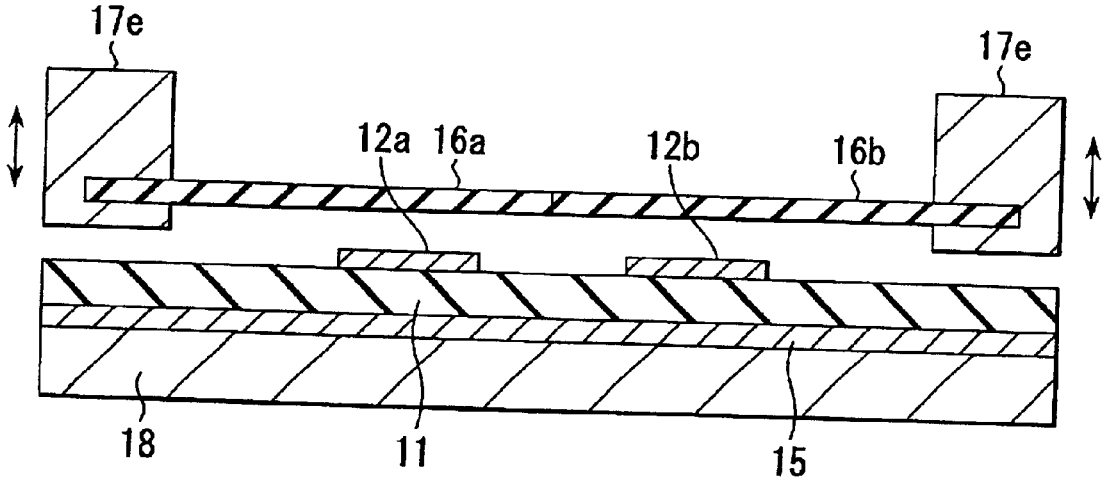

FIGS. 49A and 49B are related to a high-frequency device according to an eighteenth embodiment of the present invention. FIG. 49A is a plan view of the high-frequency device. FIG. 49B is a sectional view taken along line 49B—49B in FIG. 49A. The component parts corresponding to those in the sixteenth embodiment shown in FIG. 47A are indicated by the same reference numerals.

A dielectric substrate 11 at which resonating elements 12*a* and 12*b* constituting two band-pass filters 112*a* and 112*b* respectively and a ground plane 15 have been formed is provided on a holder 18. Two dielectric plates 16*a* and 16*b* for controlling the characteristics of the two band-pass filters respectively are provided so as to correspond to the two band-pass filters. Each of the dielectric plates 16*a* and 16*b* is supported by a substrate holding member (or spacing adjusting member) 17*e* at one end. The substrate holding member 17*e* is moved up and down, thereby adjusting the spacing between the band-pass filter and the dielectric plate.

In the sixteenth and seventeenth embodiments, the two band-pass filters 112*a* and 112*b* have been arranged in the direction in which signals are propagated and the power input terminal 13 and output terminal 14 have been provided on both sides of the same substrate. In the eighteenth embodiment, two band-pass filters 112*a* and 112*b* are arranged side by side and connected in series as shown in FIG. 49A and the power input terminal 13 and output terminal 14 are provided on one side of the same substrate.

The arrangement methods shown in the sixteenth and seventeenth embodiments have the advantage that it is easy to provide the dielectric plate in such a manner that the distance from the dielectric plate to each filter can be changed independently. As the number of stages of filters increases, however, the substrate takes a longer, narrower shape (or a shape with a higher length-to-breadth ratio), which makes the substrate expansive for its area. It is desirable that adjacent filters should be connected to each other with a superconductor film with a length of at least 2 mm. If the distance between the filters is shorter than 2 mm, one filter is influenced by the dielectric plate facing the other filter, which makes it difficult to control the transmission characteristic independently. In the arrangement methods shown in FIGS. 49A and 49B, of the two filters is provided on the right side and the other on left side, enabling a substrate with a lower length-to-breadth ratio to be used, which provides the advantage of reducing the cost of the substrate.

(Nineteenth Embodiment)

Figure 50A:
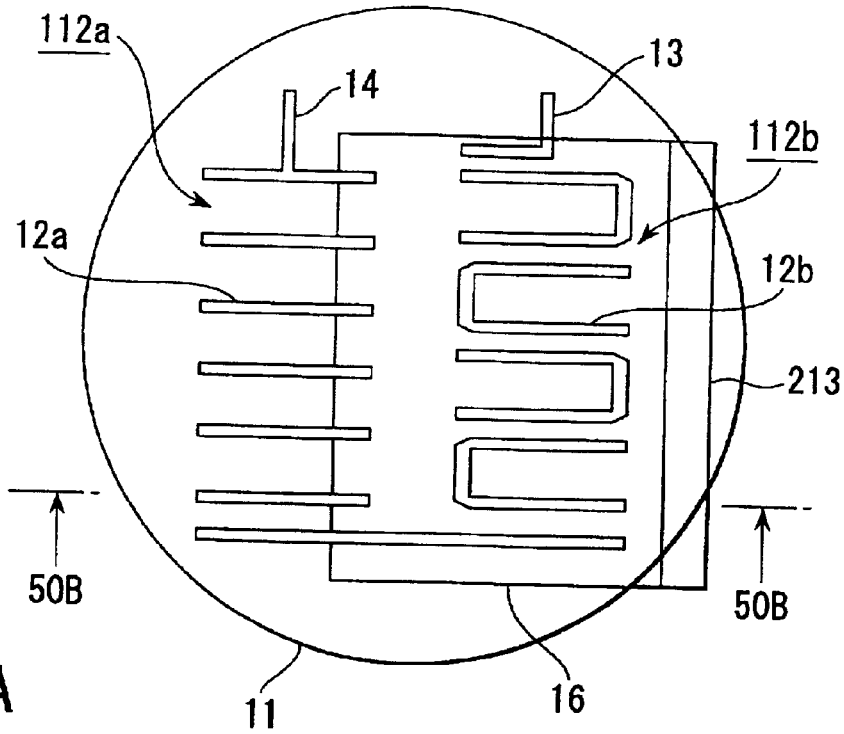
FIGS. 50A and 50B are a plan view and sectional view of a filter apparatus according to a nineteenth embodiment of the present invention, respectively.
Figure 50B:
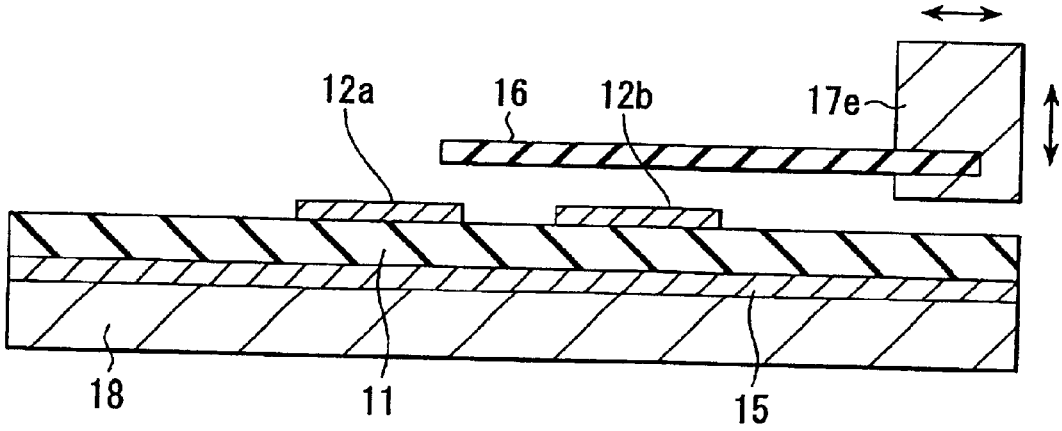

FIGS. 50A and 50B are related to a high-frequency device according to a nineteenth embodiment of the present invention. FIG. 50A is a plan view of the high-frequency device. FIG. 50B is a sectional view taken along line 50B—50B in FIG. 50A.

While in the eighteenth embodiment (see FIGS. 49A and 49B), two dielectric plates have been provided so as to correspond to the two band-pass filters 112*a* and 112*b*, the characteristic of the band-pass filter is controlled using a single dielectric plate in the nineteenth embodiment.

Furthermore, although in the eighteenth embodiment, the dielectric plate 16 has been provided so as to cover all of the resonating elements, if the individual resonating elements 12*a* and 12*b* are in the same state, the center frequency can be changed without disturbing the transmission characteristic by covering part of the individual resonating elements with the dielectric plate 16. That is, when the individual resonating elements and their arrangement are symmetrical with respect to the center line in the direction of input and output (in the method of arranging the resonating elements), a part of the dielectric plate that covers each resonating element has only to have the same area.

In the nineteenth embodiment, from the above-described viewpoint, the dielectric plate 16 covers all of the resonating elements 12*b* completely and the resonating elements 12*a* partially. The filter characteristic is adjusted by moving the dielectric plate 16 vertically or horizontally with respect to the surface of the filter.

(Twentieth Embodiment)

A twentieth embodiment of the present invention relates to a mounting method when band-pass filters formed on separate substrates are connected in series. A band-pass filter formed at each substrate is mounted in a package suitable for ultra-low temperature operations as in FIG. 12. The state is shown in FIG. 51.

Specifically, a dielectric plate 16 is attached to a holding jig 21 with a squared-U-shaped cross section by means of a fixing member 22. The holding jig 21 is installed to a lift jig 23 supported by a case 24. The holding jig 21 is lifted up and down by the lift jig 23, thereby changing the distance between the substrate 11 at which the resonating elements 12 and ground plane 15 have been formed and the dielectric plate 16. Moreover, with at least three adjustment screws (see FIG. 52), the surface of the substrate 11 and the facing surface of the dielectric plate 16 are adjusted so as to be in parallel with each other.

Figure 51:
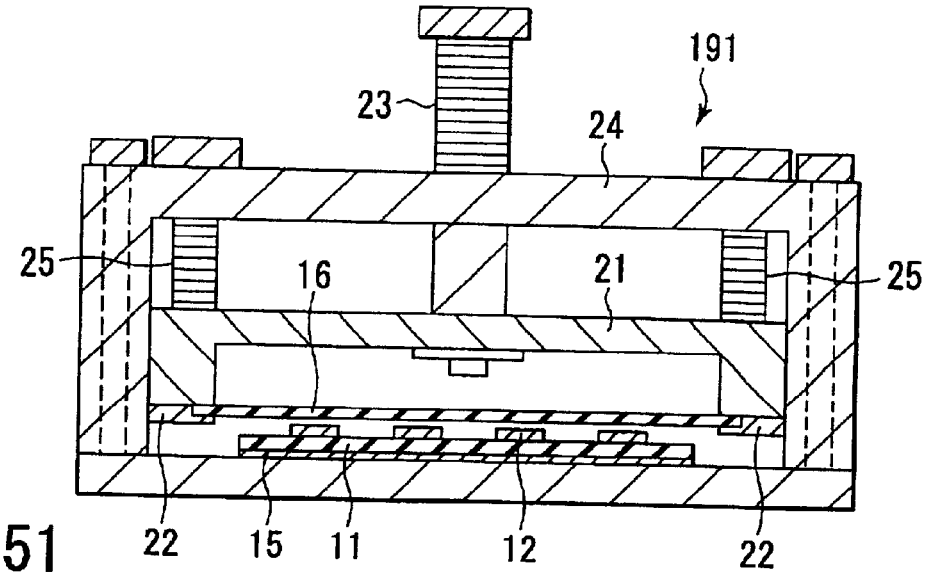
FIG. 51 is a sectional view of a high-frequency device according to a twentieth embodiment, with the front-stage or back-stage filter substrate assembled.
Figure 52:
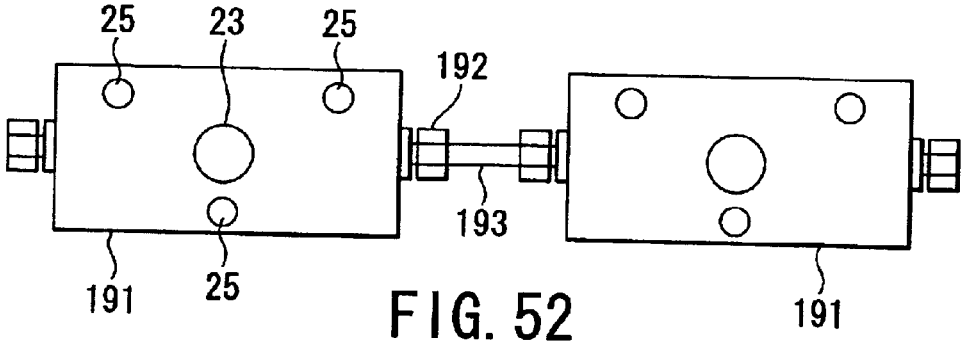
FIG. 52 shows the front-stage and back-stage band-pass filters connected in series in the twentieth embodiment.
Figure 53:
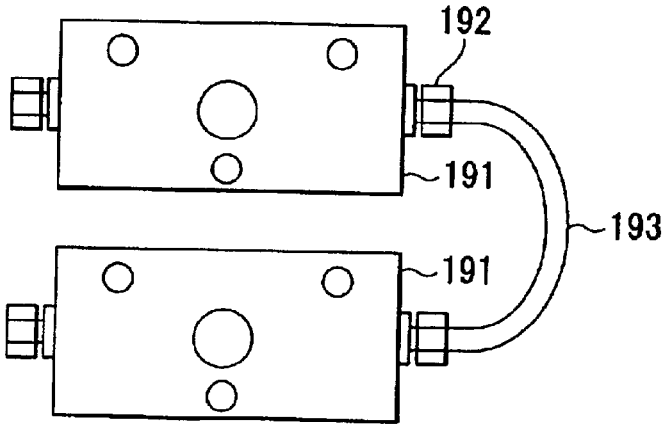
FIG. 53 shows the front-stage and back-stage band-pass filters connected in a folding manner in the twentieth embodiment.

FIGS. 52 and 53 show examples of a case where two assembly members 191 assembled as shown in FIG. 51 are connected in series, thereby connecting band-pass filters in series. The input and output terminals 192 (not shown in FIG. 51) of the two assembly members 191 are connected to each other with a coaxial cable 193.

In the example of FIG. 52, the two assembly members 191 are arranged in a line in the same direction. With this arrangement, the length of the coaxial cable can be made shorter and therefore the loss caused by connections can be decreased.

In the example of FIG. 53, the coaxial cable is bent, thereby arranging the two assembly members 191 side by side. This arrangement enables the cold head of a refrigerator to be made compact, which is particularly suitable for an increased number of filters connected in series.

Figure 54:
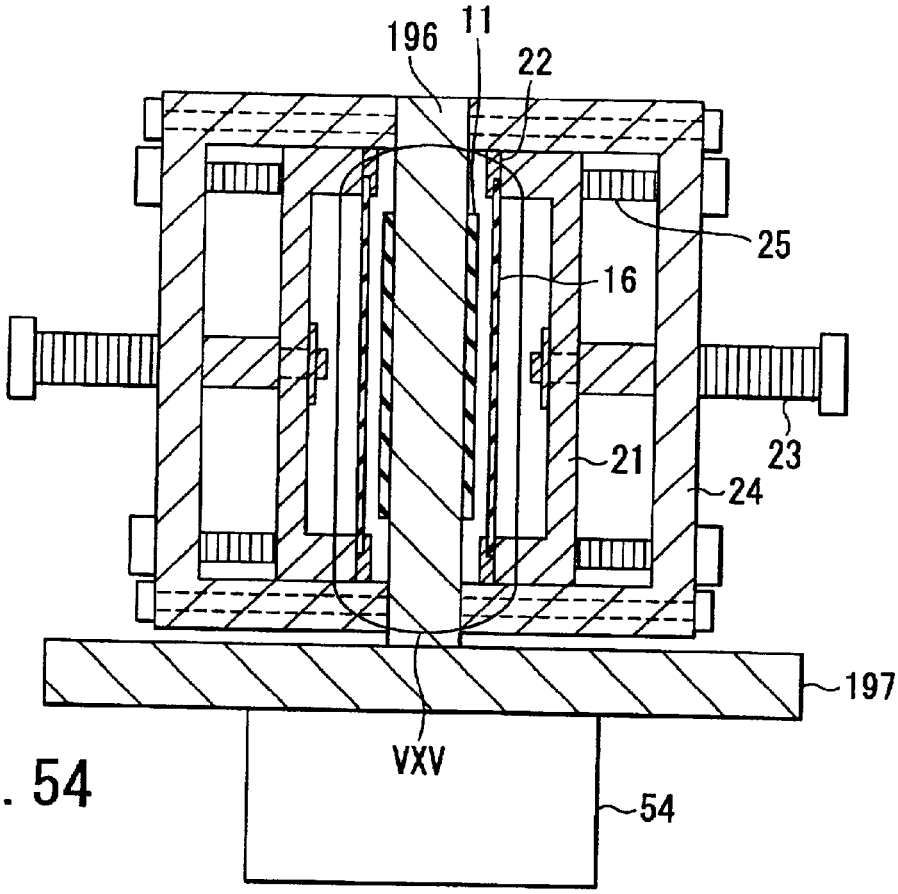
FIG. 54 is a sectional view showing an example of the front-stage and back-stage band-pass filters assembled back to back in the twentieth embodiment.
Figure 55:
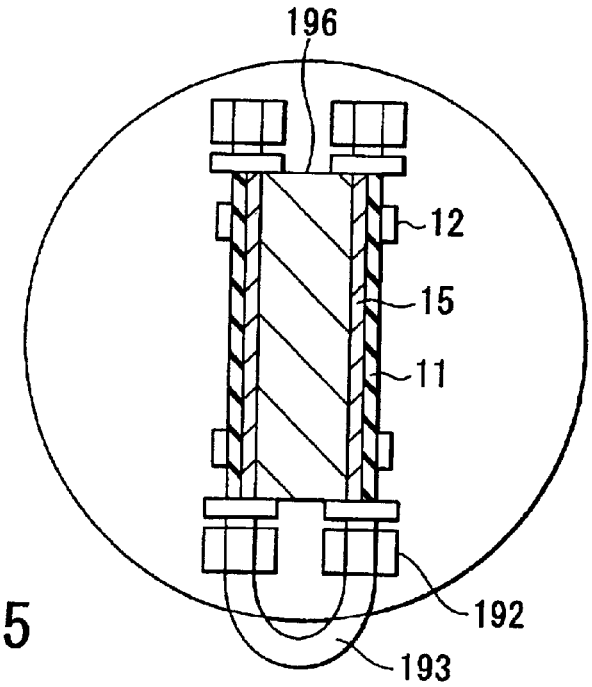
FIG. 55 is a sectional view showing a detailed method of connecting the VXV part in FIG. 54.

FIG. 54 shows an example of mounting a dielectric substrate 11 at which resonating elements 12 and a ground plane 15 have been formed on both sides of a grounded holder 196. FIG. 54 shows an overall configuration (where the resonating elements 12 and ground plane 15 are not shown). FIG. 55 is an enlarged view of the main part VXV of FIG. 54. Arranging the two dielectric substrates 11 in such a manner that they face each other enables the cold head of the refrigerator 54 to be made compact, which makes it possible to decrease not only the thermal capacity but also the number of parts.

With the tenth to twentieth embodiments, a plurality of band-pass filters composed of a plurality of resonating elements made of a superconductor film are connected in series. By controlling the resonance frequencies of the resonating elements constituting the band-pass filters, a band-pass filter with a sharp skirt characteristic and a desired transmission characteristic can be realized easily.

With the present invention, a plurality of band-pass filters composed of a plurality of resonating elements made of a superconductor film are connected in series, thereby realizing a filter with excellent characteristics, including a sharp skirt characteristic. Specifically, for example, a band-pass filter having a sharp skirt characteristic on the low-frequency side of the passband and a band-pass filter having a sharp skirt characteristic on the high-frequency side of the passband are connected in series, thereby realizing a band-pass filter having sharp skirt characteristics on both sides of the passband.

Furthermore, when band-pass filters with the same characteristics are connected in series, this provides a sharper skirt characteristic than that of each band-pass filter. When a plurality of band-pass filters are connected in series, the amount of attenuation outside the passband is the sum of the amount of attenuation outside the passband of each filter. Therefore, a large amount of attenuation outside the passband is obtained.

In addition, by connecting a plurality of band-pass filters in series, the device can be made smaller. That is, as compared with a single band-pass filter having a characteristic equivalent to that of band-pass filters connected in series, the number of stages of resonating elements in each band-pass filter can be decreased. As a result, the occupied area of each band-pass filter can be decreased.

Moreover, because a single band-pass filter has no freedom in arranging resonating elements, the shape of the occupied area is limited. When band-pass filters are connected in series, however, the individual band-pass filters can be arranged two-dimensionally or three-dimensionally with a high degree of freedom. For this reason, it is possible to make compact not only all the band-pass filters connected in series but also the entire apparatus into which band-pass filters have been incorporated.

When a plurality of band-pass filters connected in series are formed using different substrates, there is no need to use a large substrate, which makes it easy to manufacture the apparatus and therefore decreases the manufacturing cost. Furthermore, it is possible to arrange the individual band-pass filters three-dimensionally with a high degree of freedom.

When a plurality of band-pass filters connected in series are formed using the same substrate, it is difficult to secure the freedom of three-dimensional arrangement. However, it is possible to secure a high degree of freedom two-dimensionally. Because the individual band-pass filters are connected to each other with superconductor wires, it is possible to reduce the loss caused by connections.

Furthermore, a plurality of band-pass filters having part of the passband in common are connected in series, thereby forming a new band-pass filter that allows the frequencies in the common part to pass through. By controlling the resonance frequencies of the resonating elements constituting at least one band-pass filter, it is possible to adjust the transmission characteristics (including the center frequency and bandwidth) of the common part.

Specifically, the surface of the substrate at which resonating elements have been formed is made parallel with the facing surface of the member (preferably a dielectric plate) for controlling the resonance frequency. Larger than a specific area (preferably, more than half) of the individual resonating elements and the gaps between the individual resonating elements are covered with the member. Adjusting the spacing between the member and the substrate, while keeping them in parallel, enables the resonance frequencies of the individual resonating elements to be changed uniformly, which makes it possible to change the center frequency without disturbing the transmission characteristic.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A high-frequency device comprising:

a dielectric substrate with a first and a second main surface;

a filter element having a microstrip line structure, including a plurality of resonating elements made of a first superconductor film on said first main surface of said dielectric substrate;

a dielectric plate having a third and a fourth main surface, said third main surface of said dielectric plate facing said first main surface of said dielectric substrate, said dielectric plate being substantially in parallel with said first main surface, wherein when a maximum value and a minimum value of a spacing between said third main surface of said dielectric plate and a surface of said first superconductor film is L and S respectively, a value of an expression $2\times(L-S)/(L+S)$ is 0.3 or less, and said dielectric plate covering at least a part of said plurality of resonating elements; and a spacing adjusting member configured to control a spacing between said third main surface of said dielectric plate and said first main surface of said dielectric substrate.

2. A The high-frequency device according to claim 1, wherein a second superconductor film is formed on said second main surface of said dielectric substrate.

3. The high-frequency device according to claim 1, wherein a third superconductor film is formed on said fourth main surface of said dielectric plate.

4. The high-frequency device according to claim 1, wherein a second superconductor film is formed on said second main surface of said dielectric substrate and a third superconductor film is formed on said fourth main surface of said dielectric plate.

5. The high-frequency device according to claim 1, wherein a minimum distance between said spacing adjusting member and said resonating elements is three times or more as large as a pattern width of said first superconductor film of a strip line type forming said resonating elements.

6. The high-frequency device according to claim 1, wherein said spacing adjusting member is made of metal.

7. The high-frequency device according to claim 1, wherein said spacing adjusting member is made of a dielectric material.

8. The high-frequency device according to claim 1, further comprising a penetration member which is made of a dielectric material and moves up and down in a through hole formed in said dielectric plate correspondingly to and above one of said plurality of resonating elements.

9. The high-frequency device according to claim 1, wherein said spacing adjusting member includes a piezoelectric member which is provided above said fourth main surface of said dielectric plate and makes a displacement according to an applied voltage, and a connection member which connects said dielectric plate and said piezoelectric member and is movable according to said displacement of said piezoelectric member, said displacement of said piezoelectric member moving said dielectric plate via said connection member.

10. The high-frequency device according to claim 9, wherein a plane shape of said piezoelectric member is rectangular.

11. The high-frequency device according to claim 9, wherein a plane shape of said piezoelectric member is circular.

12. The high-frequency device according to claim 9, wherein said piezoelectric member is composed of a plurality of piezoelectric areas.

13. The high-frequency device according to claim 12, wherein each of said plurality of piezoelectric areas makes a displacement independently.

14. A high-frequency apparatus comprising:

a high-frequency device according to claim 9;

a memory configured to store information about relationship between said applied voltage to said piezoelectric member and a center frequency of said filter element varying according to said displacement of said piezoelectric member; and a voltage controller configured to control said applied voltage on the basis of said information about said relationship between said applied voltage and said center frequency stored in said memory, in case of changing said center frequency of said filter element.

15. A high-frequency apparatus comprising:

a high-frequency device according to claim 9;

a first memory configured to store information about a hysteresis loop representing relationship between said applied voltage to said piezoelectric member and said center frequency of said filter element varying according to said displacement of said piezoelectric member;

a second memory configured to store information about a present operating point on said hysteresis loop; and a voltage controller configured to control said applied voltage on the basis of said information about said hysteresis loop stored in said first memory and said information about said present operating point stored in said second memory, in case of changing said center frequency of said filter element.

16. A high-frequency apparatus comprising:

a high-frequency device according to claim 9;

a memory configured to store information about a plurality of hysteresis loops representing relationship between said applied voltage to said piezoelectric member and said center frequency of said filter element varying according to said displacement of said piezoelectric member; and a voltage controller configured to control said applied voltage on the basis of said information about said plurality of hysteresis loops stored in said memory, in case of changing said center frequency of said filter element.

17. A high-frequency device comprising:

a substrate;

a filter series where a plurality of band-pass filters are connected in series, each of said plurality of band-pass filters having a microstrip line structure and including a plurality of resonating elements made of a superconductor film formed on said substrate; and a resonance controller configured to control resonance frequencies of said plurality of resonating elements forming at least one band-pass filter, wherein said resonance controller includes a dielectric whose permittivity varies according to an electric field.

18. A high-frequency device comprising:

a substrate;

a filter series where a plurality of band-pass filters are connected in series, each of said plurality of band-pass filters having a microstrip line structure and including a plurality of resonating elements made of a superconductor film formed on said substrate; and a resonance controller configured to control resonance frequencies of said plurality of resonating elements forming at least one band-pass filter, wherein said resonance controller includes a magnetic material whose permeability varies according to a magnetic field.

19. A high-frequency device comprising:

a substrate;

a filter series where a plurality of band-pass filters are connected in series, each of said plurality of band-pass filters having a microstrip line structure and including a plurality of resonating elements made of a superconductor film formed on said substrate; and a resonance controller configured to control resonance frequencies of said plurality of resonating elements forming at least one band-pass filter, wherein said plurality of band-pass filters have the same center frequency and are connected to each other using connection wires whose patterns differ from patterns of said plurality of resonating elements included in said plurality of band-pass filters.

* * * * *